US011879678B1

(12) United States Patent
Vaisman et al.

(10) Patent No.: US 11,879,678 B1
(45) Date of Patent: Jan. 23, 2024

(54) THERMAL MANAGEMENT SYSTEMS

(71) Applicant: Booz Allen Hamilton Inc., McLean, VA (US)

(72) Inventors: Igor Vaisman, Carmel, IN (US); Joshua Peters, Knoxville, TN (US)

(73) Assignee: Booz Allen Hamilton Inc., McLean, VA (US)

( * ) Notice: Subject to any disclaimer, the term of this patent is extended or adjusted under 35 U.S.C. 154(b) by 135 days.

(21) Appl. No.: 17/231,084

(22) Filed: Apr. 15, 2021

Related U.S. Application Data

(60) Provisional application No. 63/039,575, filed on Jun. 16, 2020.

(51) Int. Cl.
*F25B 49/02* (2006.01)
*F25B 9/00* (2006.01)
*F25B 43/00* (2006.01)

(52) U.S. Cl.
CPC ..... *F25B 49/02* (2013.01); *F25B 9/002* (2013.01); *F25B 43/006* (2013.01); *F25B 2400/051* (2013.01)

(58) Field of Classification Search
CPC ..... F25B 49/02; F25B 9/002; F25B 43/006; F25B 2400/051
See application file for complete search history.

(56) References Cited

U.S. PATENT DOCUMENTS 3,685,310 A * 8/1972 Fischer ..... F25B 19/00 62/48.1
6,523,347 B1 2/2003 Jirnov et al.
10,126,022 B1 * 11/2018 Cooper ..... F25B 5/04
10,156,385 B1 * 12/2018 Kapsha ..... F25B 49/02
10,746,440 B2 8/2020 Donovan et al.
11,635,237 B1 4/2023 Vaisman et al.
2003/0019219 A1 * 1/2003 Viegas ..... B60H 1/3202 62/239
2017/0108247 A1 4/2017 Sata et al.
(Continued)

FOREIGN PATENT DOCUMENTS

JP 2010133606 6/2010

OTHER PUBLICATIONS

Nagano et al., "Ejector Type Refrigerating Cycle," English translation of foreign reference JP 2010133606A, Jun. 17, 2010, whole document.

(Continued)

*Primary Examiner* — Henry T Crenshaw
(74) *Attorney, Agent, or Firm* — Fish & Richardson P.C.

(57) ABSTRACT

A thermal management system includes an open-circuit refrigeration system including a cooling system configured to supply a cooling medium. The open-circuit refrigeration system includes a receiver having a receiver outlet, the receiver configurable to store a refrigerant fluid, the receiver configured to receive the cooling medium from the cooling system, an evaporator coupled to the receiver outlet, the evaporator configurable to receive liquid refrigerant fluid from the receiver outlet and to extract heat from a heat load when the heat load contacts or is proximate to the evaporator a control device configurable to control a temperature of the heat load and an exhaust line, with the receiver, the evaporator, and the exhaust line coupled to form an open-circuit refrigerant fluid flow path.

28 Claims, 26 Drawing Sheets

(56) References Cited

U.S. PATENT DOCUMENTS

| | | | |
|---|---|---|---|
| 2018/0306528 | A1 | 10/2018 | Girardi et al. |
| 2019/0072035 | A1 | 3/2019 | Peace et al. |
| 2020/0058468 | A1 | 2/2020 | Takahashi et al. |
| 2020/0363101 | A1 | 11/2020 | Jansen |
| 2021/0095901 | A1 | 4/2021 | Perez-Blanco |
| 2021/0197736 | A1 | 7/2021 | Iovine |
| 2021/0348789 | A1 | 11/2021 | Fukui et al. |
| 2022/0186943 | A1 | 6/2022 | Kibe et al. |

OTHER PUBLICATIONS

U.S. Appl. No. 17/231,092, filed Apr. 15, 2021, Vaisman et al.
U.S. Appl. No. 17/231,108, filed Apr. 15, 2021, Vaisman et al.
U.S. Appl. No. 17/231,127, filed Apr. 15, 2021, Vaisman et al.

* cited by examiner

THERMAL MANAGEMENT SYSTEMS

CLAIM OF PRIORITY

This application claims priority under 35 USC § 119(e) to U.S. Provisional Patent Application Ser. No. 63/039,575, filed on Jun. 16, 2020, and entitled "THERMAL MANAGEMENT SYSTEMS," the entire contents of which are hereby incorporated by reference.

BACKGROUND

This disclosure relates to refrigeration systems.

Refrigeration systems absorb thermal energy from heat sources operating at temperatures above the temperature of the surrounding environment, and discharge thermal energy into the surrounding environment. Conventional refrigeration systems can include at least a compressor, a heat rejection exchanger (i.e., a condenser), a liquid refrigerant receiver, an expansion device, and a heat absorption exchanger (i.e., an evaporator). Such systems can be used to maintain operating temperature set points for a wide variety of cooled heat sources (loads, processes, equipment, systems) thermally interacting with the evaporator.

While closed-circuit refrigeration systems may pump significant amounts of absorbed thermal energy from heat sources into the surrounding environment, such systems may not be adequate for specific applications. Consider that condensers and compressors are generally heavy and consume relatively large amounts of power for a given amount of heat removal capacity. In general, the larger the amount of absorbed thermal energy that the system is designed to handle, the heavier the refrigeration system and the larger the amount of power consumed during operation, even when cooling of a heat source occurs over relatively short time periods.

SUMMARY

According to an aspect, a thermal management system includes a cooling system configured to supply a cooling medium, an open-circuit refrigeration system including a receiver having a receiver outlet, the receiver configurable to store a refrigerant fluid, with the cooling system configurable to cool the refrigerant fluid in the receiver with the cooling medium, an evaporator coupled to the receiver outlet, the evaporator configurable to receive refrigerant fluid from the receiver outlet and to extract heat from a heat load when the heat load contacts or is in proximity to the evaporator, a control device configurable to control a temperature of the heat load, and an exhaust line, with the receiver, the evaporator, the control device, and the exhaust line coupled to form an open-circuit refrigerant fluid flow path.

The above aspect may include amongst features described herein one or more of the following features.

The system further includes a suction accumulator having an inlet and a vapor side outlet, the suction accumulator configurable to separate the refrigerant from the evaporator into refrigerant vapor and refrigerant liquid and provide the refrigerant vapor at the vapor-side outlet of the suction accumulator. The refrigerant fluid comprises ammonia.

The cooling system includes a thermally insulated container that houses the receiver, the evaporator and the suction accumulator. The control device is included in the thermally insulated container. The control device is not included in the thermally insulated container. The cooling system further includes a source of coolant medium, with the source being proximate to the thermally insulated container.

The cooling system includes an evaporator cooler or a heat exchanger within the receiver, and the cooling system is proximate to the evaporator cooler or heat exchanger.

The receiver has a receiver shell and the cooling system includes an evaporator cooler or a heat exchanger integrated within the receiver shell and the cooling system is proximate to the evaporator cooler or heat exchanger.

When the control device is actuated, the exhaust line emits refrigerant vapor without returning the emitted refrigerant vapor to the receiver. The control device is a back-pressure regulator. The system further includes a controller configured to control operation of the control device.

The system is configured to operate the evaporator at a defined vapor quality in a range of 0.3 to almost 1.0.

According to an aspect, a thermal management method includes cooling, by a cooling system, an open-circuit refrigeration system, transporting refrigerant fluid through the open-circuit refrigeration system from a receiver having a receiver outlet to an evaporator having an inlet and an outlet, while extracting heat from a heat load in thermal proximity to the evaporator, and exhausting the refrigerant vapor though a control device coupled to the outlet of the evaporator and configurable to control a temperature of the heat load, with the evaporator, the receiver, the control device, and the exhaust line coupled to form an open-circuit refrigerant fluid flow path.

The method further includes separating, with a liquid separator, refrigerant fluid from the evaporator outlet into a liquid phase and a vapor phase and transporting the vapor phase from a vapor-side outlet of the liquid separator to an inlet of the control device.

The refrigerant fluid comprises ammonia.

Cooling further includes housing the open-circuit refrigeration system in a thermally insulated container and directing cooling medium into the thermally insulated container. The control device is included in the thermally insulated container and the exhaust line is not included in the thermally insulated container. The control device is not included in the thermally insulated container.

Cooling further includes directing cooling medium from the cooling system that is proximate to the thermal insulated container.

Cooling further includes cooling the receiver by an evaporator cooler or a heat exchanger disposed in the receiver, with a cooling system that is proximate to the evaporator cooler or heat exchanger.

Cooling further includes cooling the receiver with an evaporator cooler or a heat exchanger integrated within a receiver shell with a cooling system that is proximate to the evaporator cooler or heat exchanger.

When the control device is actuated, the exhaust line discharges refrigerant vapor without returning the discharged refrigerant vapor to the receiver.

The control device is a back pressure regulator.

A controller is configured to control operation of the back-pressure regulator, by receiving a signal from a sensor device that is configured to measure a thermodynamic property of the refrigerant in the open-circuit refrigerant fluid flow path.

The method is configured to operate the evaporator at a defined vapor quality in a range of 0.3 to almost 1.0.

One or more of the above aspects may include amongst features described herein one or more of the following features.

Some of examples of open-circuit refrigeration systems (OCRS) operate at two pressure levels, i.e., a source of liquid refrigerant is maintained at a high (supply) pressure level and the evaporation process is executed at a comparatively lower evaporating pressure. The source of refrigerant is at an ambient temperature. In some applications this arrangement is suitable.

However, in other applications, use of ambient temperature is undesirable. The disclosed OCRS uses a liquid refrigerant receiver and includes apparatus to cool the liquid refrigerant, which resides in the liquid refrigerant receiver. OCRS performance depends on the temperature of the liquid refrigerant in the liquid receiver. The lower the liquid refrigerant temperature, the lesser amount of the refrigerant flow rate that is required to cool a given heat load, and the lesser the liquid refrigerant charge that is needed to maintain the cooling duty over a given period of operation. This results in a more compact and lighter refrigeration system for thermal energy device applications.

DETAILED DESCRIPTION

Cooling of high heat flux loads that are also highly temperature sensitive can present a number of challenges. On one hand, such loads generate significant quantities of heat that is extracted during cooling. In conventional closed-cycle refrigeration systems, cooling high heat flux loads typically involves circulating refrigerant fluid at a relatively high mass flow rate. However, closed-cycle system components that are used for refrigerant fluid circulation—including compressors and condensers—are typically heavy and consume significant power. As a result, many closed-cycle systems are not well suited for deployment in mobile platforms—such as on small vehicles—where size and weight constraints may make the use of large compressors and condensers impractical.

Temperature sensitive loads such as electronic components and devices may require temperature regulation within a relatively narrow range of operating temperatures. Maintaining the temperature of such a load to within a small tolerance of a temperature set point can be challenging when a single-phase refrigerant fluid is used for heat extraction, since the refrigerant fluid itself will increase in temperature as heat is absorbed from the load. One example of such loads are components, e.g., laser diodes, in directed energy systems.

Directed energy systems that are mounted to mobile vehicles such as trucks may present many of the foregoing operating challenges, as such systems may include high heat flux, temperature sensitive components that require precise cooling during operation in and over relatively short time intervals. The thermal management systems disclosed herein, while generally applicable to the cooling of a wide variety of thermal loads, are particularly well suited for operation with such directed energy systems.

In particular, the thermal management systems and methods disclosed herein include a number of features that reduce both overall size and weight relative to conventional refrigeration systems, and still extract excess heat energy from both high heat flux, highly temperature sensitive components and relatively temperature insensitive components, to accurately match temperature set points for the components. At the same time the disclosed thermal management systems require no significant power to sustain their operation. Whereas certain conventional refrigeration systems used closed-circuit refrigerant flow paths, the systems and methods disclosed herein use open-circuit refrigerant flow paths. Depending upon the nature of the refrigerant fluid, exhaust refrigerant fluid may be incinerated as fuel, chemically treated, and/or simply discharged at the end of the flow path.

II. Thermal Management Systems with Open-Circuit Refrigeration Systems

Figure 1:
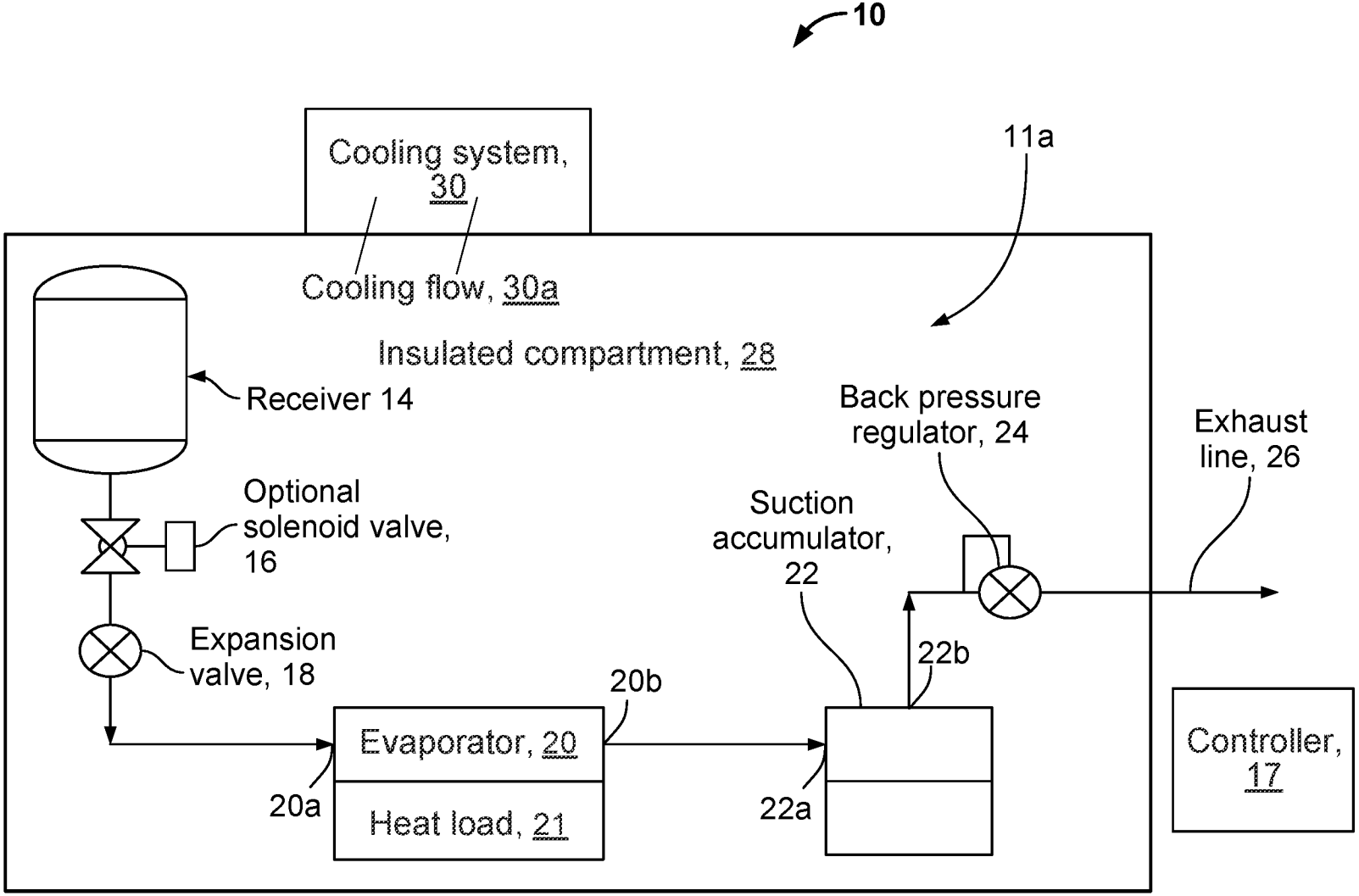
FIG. 1 is a schematic diagram of a thermal management system (TMS) that includes an open-circuit refrigeration system (OCRS) that includes a refrigerant receiver with a cooler.

Referring now to FIG. 1, a thermal management system 10 (TMS 10) includes an open-circuit refrigeration system 11*a* (OCRS 11*a*). OCRS 11*a* includes a refrigerant receiver 14 that stores cooled liquid refrigerant, an optional solenoid control valve 16, and an expansion valve 18 that are coupled to an inlet 20*a* of an evaporator 20. The evaporator 20 further has an outlet 20*b* that is coupled to an inlet 22*a* of a suction accumulator 22 (that can be implemented as a liquid separator). A control device 24 (e.g., a back-pressure regulator) is coupled to the vapor side outlet 22*b* of the suction accumulator 22. The foregoing are coupled via conduits (not referenced). A heat load 21 is thermally coupled to (or in close proximity with) the evaporator 20.

Referring momentarily to FIGS. 1-4 below, in those figures the suction accumulator 22 is used, because the suction accumulator 22 only has two active ports, an inlet 22*a* and a vapor-side outlet 22*b*. Generally, the suction accumulator 22 can be implemented as a liquid separator that further has a liquid-side outlet (not shown). With a suction accumulator implemented as a liquid separator, the liquid-side outlet can be coupled to the inlet port 22*a* or is otherwise not used.

Referring momentarily to FIGS. 5A-5D, those embodiments will use a liquid separator 22' having, in addition to the inlet 22*a* and the vapor-side outlet 22*b*, a liquid-side outlet 22*c*. The liquid-side outlet 22*c* of the liquid separator 22' in those embodiments is coupled to other components of the TMS 10, as will be discussed below in conjunction with FIGS. 5A-5D.

Some embodiments may not have the suction accumulator 22. In those embodiments, the evaporator 20 outlet is coupled to an inlet to the control device 24. Some embodiments may have the suction accumulator 22 downstream from the back-pressure regulator 24. In those embodiments, the evaporator 20 outlet is coupled to an inlet to the back-pressure regulator 24 and the outlet from the back-pressure regulator 24 is coupled to the suction accumulator 22 inlet 22*a*, with the vapor-side outlet of the suction accumulator coupled to the exhaust line 26.

Referring again to FIG. 1, OCRS 11*a* stores liquid refrigerant in the receiver 14. The liquid refrigerant is fed from the receiver 14 into the evaporator inlet 20*a* and to the evaporator 20 where evaporation occurs at a certain (evaporating) pressure and temperature. The heat load 21 demand on the evaporator 20 and the pumped mass flow rate in general determine vapor quality of the refrigerant at the evaporator outlet 20*b*. Vapor or a liquid/vapor mixture at the evaporator outlet 20*b* is fed via inlet 22*a* into the suction accumulator 22 that separates the liquid from the vapor, and discharges vapor via vapor side outlet 22*b* to the back-pressure regulator 24, which then channels the vapor out of TMS 10 via an exhaust line 26. The back-pressure regulator 24 is closed when the OCRS 11*a* is OFF and is open or on when the OCRS 11*a* is ON.

In order to extend the useful life of OCRS 11*a*, cooling of the refrigerant is provided. Cooling of the refrigerant is provided by a coolant medium or cooling fluid that is flowed over and/or through at least the refrigerant receiver 14.

In a first example, as shown in FIG. 1, the OCRS 11*a* includes a cooling arrangement embodied as an insulated container or compartment 28 and cooling is provided by a cooling system 30 that is external to the container or compartment 28, and which cooling system 30 provides a cooling fluid 30*a* over the receiver 14 and the other features of the OCRS 11*a* except for the exhaust line 26, which is external to the container or compartment 28.

The disclosed OCRS 11*a* uses the cooling system 30 to cool the liquid refrigerant in the liquid refrigerant receiver 14. This makes the OCRS 11*a* lighter and more compact than a comparable closed-circuit refrigeration system of comparable cooling capacity.

OCRS 11*a* performance depends on the temperature of the liquid refrigerant in the receiver 14. The lower the liquid refrigerant temperature, the lesser amount of the refrigerant flow rate that is required to cool a given heat load, and the lesser the liquid refrigerant charge that is needed to maintain the cooling duty over a given period of operation.

The refrigerant flow rate required to cool the given heat load is $$\dot{m} = \frac{Q_{evp}}{(h_o - h_i)},$$

where $\dot{m}$—is the refrigerant mass flow rate in kilograms/second (kg/s), $Q_{evp}$—is the evaporating capacity in kilowatts (kW); $h_o$—is the enthalpy at the evaporator exit in kilojoules/kilogram (kJ/kg); and $h_i$—is the enthalpy at the evaporator inlet in (kJ/kg).

The lower the liquid refrigerant temperature is, the lower the evaporator inlet enthalpy $h_i$ is, and the smaller is the mass flow rate $\dot{m}$. The lower is the mass flow rate $\dot{m}$ is, the lesser amount refrigerant charge $\dot{m}\cdot\tau$ that is required to operate within a given period $\tau$ and the lesser amount of the exhausted refrigerant. Also, the lowered liquid temperature and the evaporator inlet enthalpy reduces the vapor quality at the evaporator 20, improving liquid refrigerant distribution, and reduce evaporator sizes. All of the above makes the disclosed OCRS 11*a* lighter and more compact than examples of OCRSs.

In general, a wide range of different mechanical and electrical/electronic devices can be used as back-pressure regulator 24. Typically, mechanical back-pressure regulating devices have an orifice and a spring supporting the moving seat against the pressure of the refrigerant fluid stream. The moving seat adjusts the cross-sectional area of the orifice and the refrigerant fluid volume and mass flow rates.

Typical electrical back-pressure regulating devices include an orifice, a moving seat, a motor or actuator that changes the position of the seat in respect to the orifice, via a controller 17, and a pressure sensor at the evaporator exit or at the valve inlet. If the refrigerant fluid pressure is above a set-point value, the seat moves to increase the cross-sectional area of the orifice and the refrigerant fluid volume and mass flow rates to re-establish the set-point pressure value. If the refrigerant fluid pressure is below the set-point value, the seat moves to decrease the cross-sectional area and the refrigerant fluid flow rates.

In general, back-pressure regulators are selected based on the refrigerant fluid volume flow rate, the pressure differential across the regulator, and the pressure and temperature at the regulator inlet. Examples of suitable commercially available back-pressure regulators that can function as back-pressure regulator 24 include, but are not limited to, valves available from the Sporlan Division of Parker Hannifin Corporation (Washington, MO) and from Danfoss (Syddanmark, Denmark).

A variety of different refrigerants can be used in system 11*a*. For open-circuit refrigeration systems, in general, emissions regulations and operating environments may limit the types of refrigerants that can be used. For example, in certain embodiments, the refrigerant can be ammonia having very large latent heat; after passing through the cooling circuit, the ammonia refrigerant can be disposed of by incineration, by chemical treatment (i.e., neutralization), and/or by direct venting to the atmosphere. In certain embodiments, the refrigerant fluid can be an ammonia-based mixture that includes ammonia and one or more other substances. For example, mixtures can include one or more additives that facilitate ammonia absorption or ammonia burning. More generally, any fluid can be used as a refrigerant in the open-circuit refrigeration systems disclosed herein, provided that the fluid is suitable for cooling heat load 21 (e.g., the fluid boils at an appropriate temperature) and, in embodiments where the refrigerant fluid is exhausted directly to the environment, regulations and other safety and operating considerations do not inhibit such discharge.

During operation of OCRS 11*a*, cooling can be initiated by a variety of different mechanisms. In some embodiments, for example, OCRS 11*a* includes a temperature sensor attached to heat load 21 (as will be discussed subsequently).

When the temperature of heat load 21 exceeds a certain temperature set point (i.e., threshold value), controller 17 connected to the temperature sensor can initiate cooling of heat load 21.

Alternatively, in certain embodiments, OCRS 11*a* operates essentially continuously—provided that the refrigerant fluid pressure within liquid refrigerant receiver is sufficient—to cool heat load 21. As soon as the receiver 14 is charged with refrigerant fluid, refrigerant fluid is ready to be directed into evaporator 20 to cool the heat load 21. In general, cooling is initiated when a user of the system or the heat load issues a cooling demand.

Upon initiation of a cooling operation, refrigerant fluid, i.e., refrigerant liquid, from the receiver 14 is discharged, and is transported through conduit to the inlet 20*a* of the evaporator 20. Inside evaporator 20 a heat exchange occurs in which heat is transferred from the heat load 21 to refrigerant liquid causing a portion of the refrigerant liquid to change to refrigerant vapor at a vapor quality at the evaporator outlet 20*b*.

Once inside the evaporator 20, the refrigerant fluid undergoes constant enthalpy expansion from an initial pressure $p_r$ (i.e., the inlet pressure) to an evaporation pressure $p_e$, and is maintained at that pressure during open-circuit operation. In general, the evaporation pressure $p_e$ depends on a variety of factors, most notably the desired temperature set point value (i.e., the target temperature) at which the heat load 21 is to be maintained and the heat input generated by the heat load 21.

When the refrigerant liquid is directed into evaporator 20, the liquid phase absorbs heat from heat load 21, driving a phase transition of the liquid refrigerant fluid into the vapor phase. Because this phase transition occurs at (nominally) constant temperature, the temperature of the refrigerant fluid mixture within evaporator 20 remains unchanged, provided at least some liquid refrigerant fluid remains in evaporator 20 to absorb heat.

Further, the cooled refrigerant fluid temperature of the refrigerant fluid entering the evaporator 20 can result in less refrigerant fluid being employed for a given amount of heat absorption from the heat load 21. In addition, one can regulate the refrigerant fluid pressure $p_e$ upstream from evaporator 20 (e.g., using back-pressure regulator 24), the temperature of the refrigerant fluid within evaporator 20 (and, nominally, the temperature of heat load 21) can be controlled to match a specific temperature set-point value for heat load 21, ensuring that heat load 21 is maintained at, or very near, a target temperature.

In some embodiments, for example, the evaporation pressure of the refrigerant fluid can be adjusted by the back-pressure regulator 24 to ensure that the temperature of heat load 21 is maintained to within ±5 degrees C. (e.g., to within ±4 degrees C., to within ±3 degrees C., to within ±2 degrees C., to within ±1 degree C.) of the temperature set point value for heat load 21.

As discussed above, within evaporator 20, a portion of the liquid refrigerant in the two-phase refrigerant fluid mixture is converted to refrigerant vapor by undergoing a phase change. As a result, the refrigerant fluid mixture that emerges from evaporator 20 has a higher vapor quality (i.e., the fraction of the vapor phase that exists in refrigerant fluid mixture) than the refrigerant fluid mixture that enters evaporator 20.

As the refrigerant fluid mixture emerges from evaporator 20, a portion of the refrigerant fluid can optionally be used to cool one or more additional thermal loads. Typically, for example, the refrigerant fluid that emerges from evaporator 20 is nearly in the vapor phase. The refrigerant fluid vapor (or, more precisely, high vapor quality fluid vapor) can be directed into a heat exchanger (not depicted) coupled to another thermal load, and can absorb heat from the thermal load during propagation through the heat exchanger. Examples of systems in which the refrigerant fluid emerging from evaporator 20 is used to cool additional thermal loads will be discussed in more detail below.

The refrigerant fluid emerging from evaporator 20 is transported through conduit to back-pressure regulator 24, which directly or indirectly, controls the upstream pressure, that is, the evaporating pressure $p_e$ in the system. After passing through back-pressure regulator 24, the refrigerant fluid is discharged as exhaust through exhaust line 26. Refrigerant fluid discharge can occur directly into the environment surrounding OCRS 11*a*. Alternatively, in some embodiments, the refrigerant fluid can be further processed; various features and aspects of such processing are discussed in further detail below.

It should be noted that the foregoing steps, while discussed sequentially for purposes of clarity, occur simultaneously and continuously during cooling operations. In other words, during operation of the OCRS 11*a*, refrigerant liquid is continuously being discharged from the refrigerant receiver 14 into evaporator 20, flowing continuously through evaporator 20 and removing heat from heat load 21. A mixture of refrigerant liquid and vapor emerges from the evaporator 20 and is transported to the inlet 22*a* of the suction accumulator 22. The suction accumulator 22 separates refrigerant vapor that is pulled by the back-pressure regulator 24 and is released, not returned to the suction accumulator 22 or the receiver 14.

During operation of TMS 10, as refrigerant fluid is drawn from the receiver 14 and used to cool heat load 21, the amount of refrigerant liquid falls. If the refrigerant liquid is reduced to a value that is too low, the pressure in the suction accumulator 22 can be an indicator of the remaining operational time. An appropriate warning signal can be issued (e.g., by a system controller 17) to indicate that, in a certain period of time, the system may no longer be able to maintain adequate cooling performance; operation of the system can even be halted.

Liquid and vapor in the suction accumulator 22 are in thermal equilibrium with surrounding environment and fully defined by the environment. The back-pressure regulator 24 should be set to control a pressure at or above the saturated refrigerant pressure at the temperature of the surrounding environment.

The back-pressure regulator 24 can also be set to control a pressure below the saturated refrigerant pressure at the temperature of the surrounding environment. In this case, a refrigerant discharge may occur when the OCRS 11*a* is ON and the back-pressure regulator 24 opens. It is preferred that the OCRS 11*a* is configured to discharge vapor only. The set pressure is virtually the saturated (or evaporating) pressure if related pressure drops are neglected.

Figure 2:
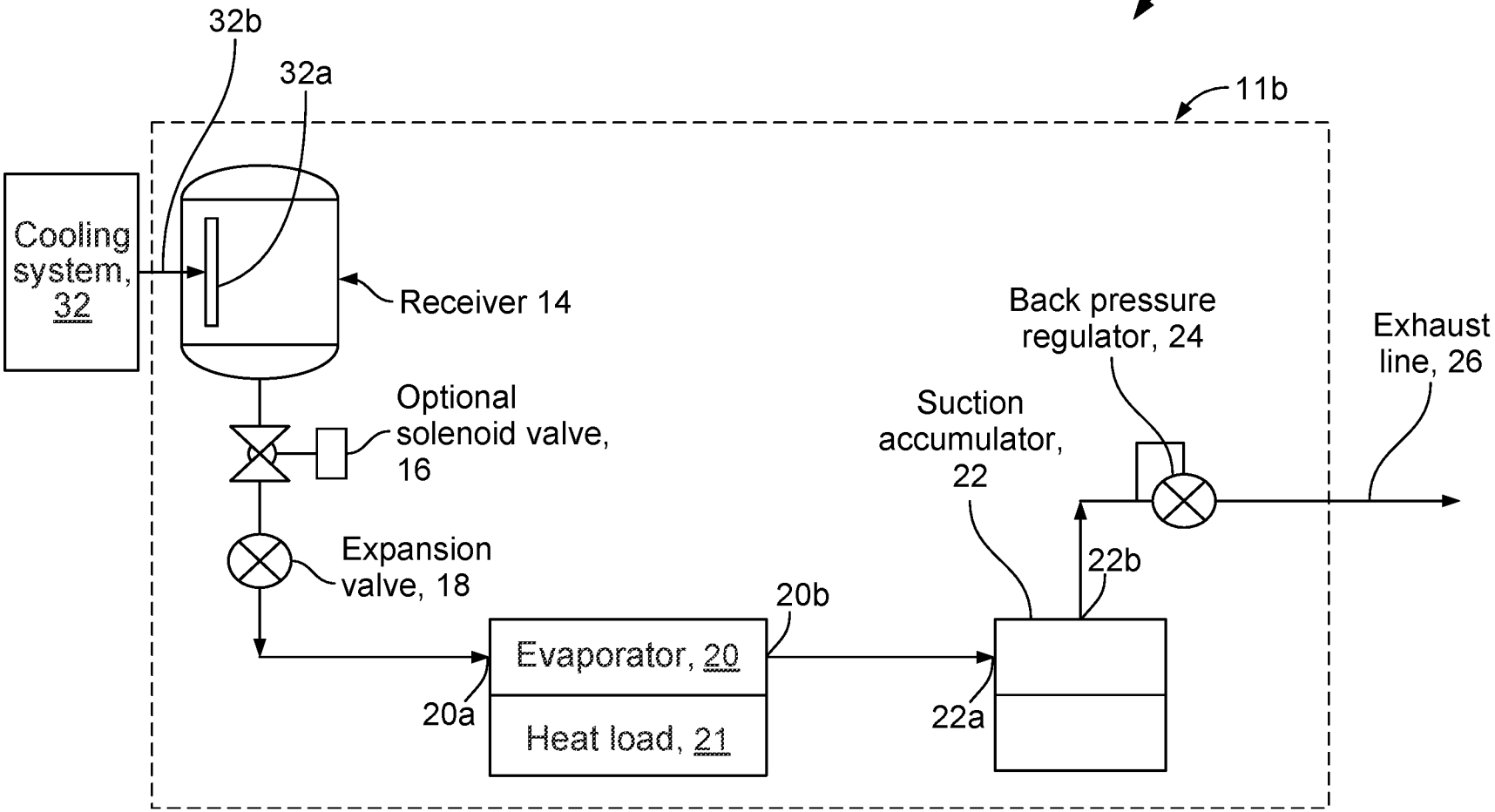
FIG. 2 is a schematic diagram of a TMS that includes an OCRS that includes a refrigerant receiver with an internal cooler.

Referring now to FIG. 2, an alternative OCRS 11*b* is shown. OCRS 11*b* includes the elements of OCRS 11*a*, as discussed above, except that cooling does not include the insulated compartment 28 (FIG. 1). Instead, TMS 10 includes a cooling system 32 with a cooling heat exchanger or evaporator 32*a* that is disposed within the receiver 14. The features of OCRS 11*a* are otherwise as discussed in FIG. 1.

The cooling system 32 provides a temperature-controlled environment within the receiver 14. Cooling of the liquid refrigerant is provided by the cooling fluid 32*b* that is flowed through the cooling heat exchanger 32*a* within the refrigerant receiver 14. The refrigerant can contact the cooling heat exchanger 32*a* drawing heat from the refrigerant in the receiver 14.

Figure 3:
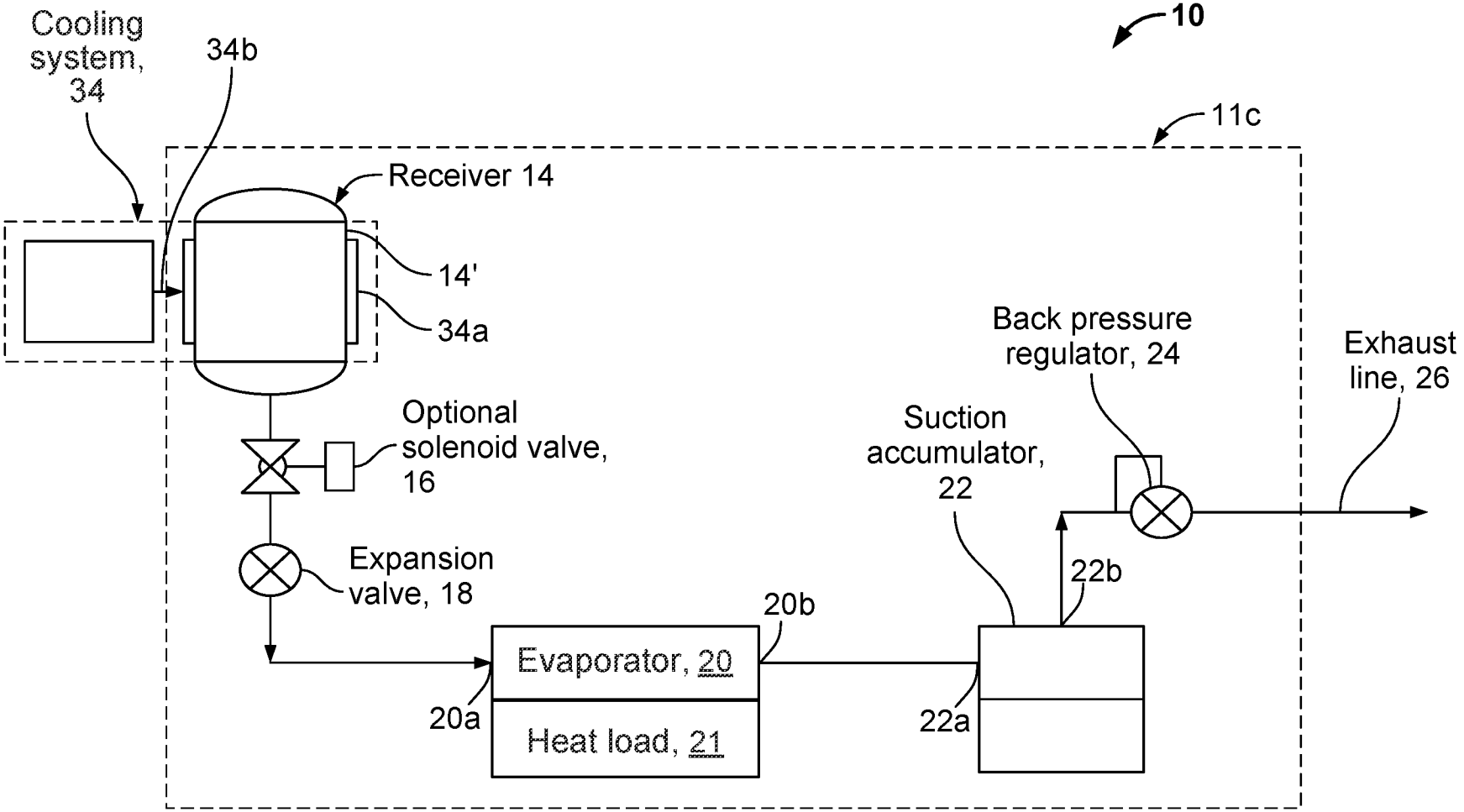
FIG. 3 is a schematic diagram of a TMS that includes an OCRS that includes a refrigerant receiver with a cooler embedded in a receiver shell.

Referring now to FIG. 3, another alternative OCRS 11*c* is shown. OCRS 11*c* includes the elements of OCRS 11*a*, as discussed above, except for cooling system 32. Instead, an alternative cooling system 34 is used. Cooling system 34 includes a cooling heat exchanger or evaporator 34*a* that is embedded within or about a shell portion 14' of the receiver 14. The cooling system 34 provides a temperature-controlled environment within the receiver 14. Cooling of the liquid refrigerant is provided by cooling fluid 34*b* that is flowed within the shell 14' of the refrigerant receiver 14, and which draws heat from the refrigerant in the receiver 14.

Figure 4:
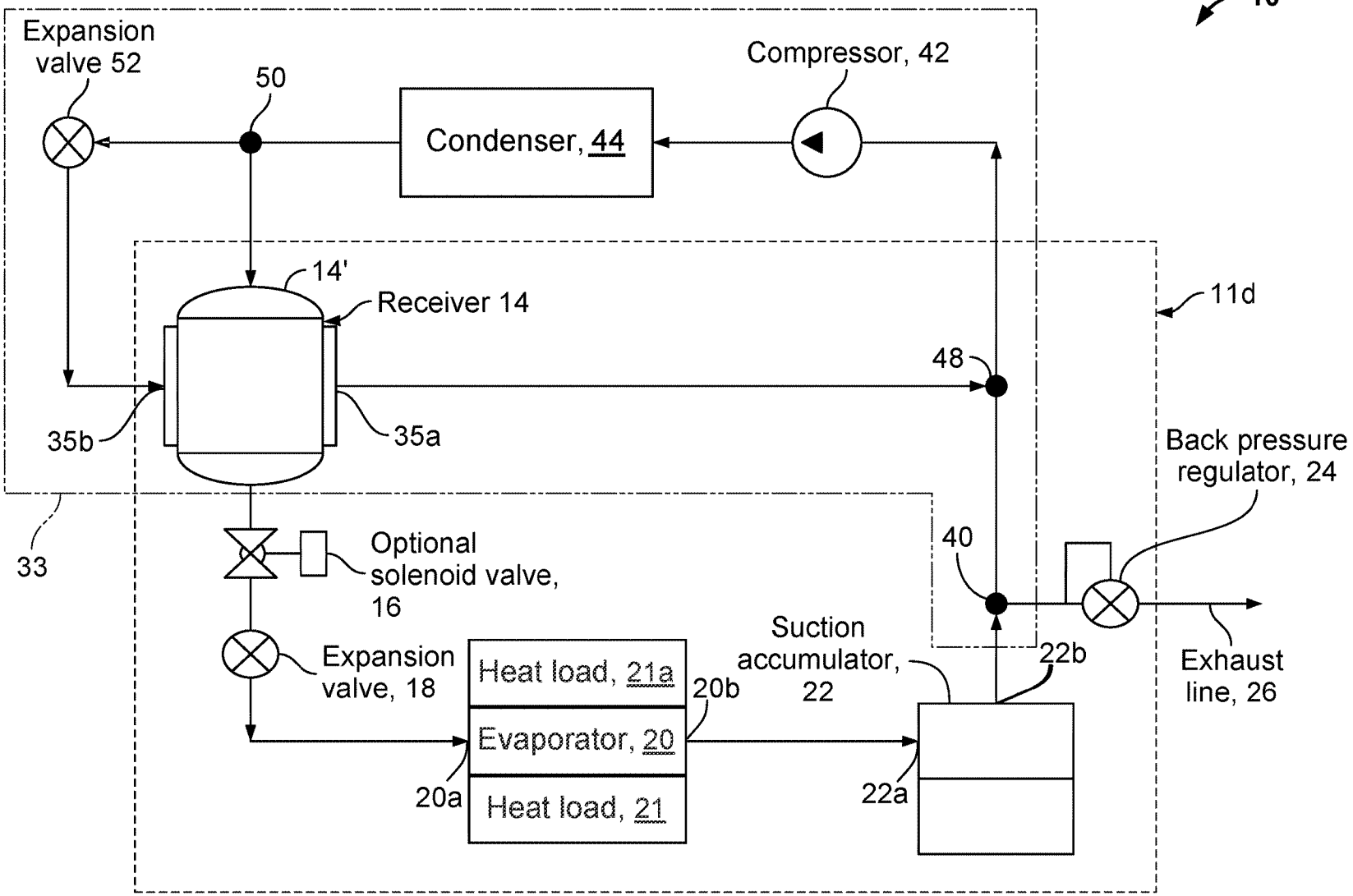
FIG. 4 is a schematic diagram of a TMS that includes an OCRS with a refrigerant receiver and a cooler, which is integrated with a closed-circuit refrigeration system.

Referring now to FIG. 4, another alternative OCRS 11*d* is shown. The system of FIG. 4 comprises a built-in cooling arrangement. The OCRS 11*d* includes the features of OCRS 11*a* except for the insulated container or compartment 28 and the external cooling system 30 of FIG. 1. Instead the OCRS 11*d* includes an integrated closed-circuit cooling system 33 that comprises the receiver 14, a first junction 40 having an inlet coupled to the vapor side outlet 22*b* of the liquid separator 22, and having first and second junction outlets. One junction outlet is coupled to the inlet to the back-pressure regulator 24 and the other junction outlet is coupled to a first inlet of a second junction 48. A second inlet of the second junction 48 is coupled to an outlet 35*a* of a receiver shell (or jacket functioning as an evaporator) 14', and an outlet of the junction 48 is coupled to an inlet of a compressor 42. A compressor outlet is coupled to an inlet of a condenser 44, with a condenser outlet coupled to an inlet of a third junction 50. A first outlet of the third junction 50 is coupled to an inlet of the receiver 14, whereas a second outlet of the third junction 50 is coupled to a second control device, such as an expansion valve 52. An outlet of the second expansion valve 52 is coupled to an inlet 35*b* of the receiver shell 14'. The outlet of the receiver 14 is coupled to the optional solenoid valve 16.

In this configuration, the addition of the compressor 42 and condenser 44 provides a closed loop path that is used to cool the refrigerant liquid in the receiver 14. The condenser 44 provides the coolant medium or cooling fluid that is flowed about the refrigerant receiver 14 and contacts the receiver shell 14' that functions as a cooling heat exchanger that draws heat from the refrigerant in the receiver 14.

In this configuration, the closed-circuit cooling system 33 can be used to cool more than heat load 21. For example, a second heat load 21*a* can be in proximity to the evaporator 20. Heat load 21 is generally a high heat load, i.e., a high heat flux load that is highly temperature sensitive, whereas heat load 21*a* is a low heat load, i.e., a low heat flux load that is less temperature sensitive relative to high heat load 21. The low heat load 21*a* is cooled by operation of the closed-circuit refrigeration system, with the back-pressure regulator 24 placed in an "OFF" state, whereas the high heat load is cooled by operation of the closed-circuit refrigeration system, with the back-pressure regulator 24 placed in an "ON" state.

Figure 4A:
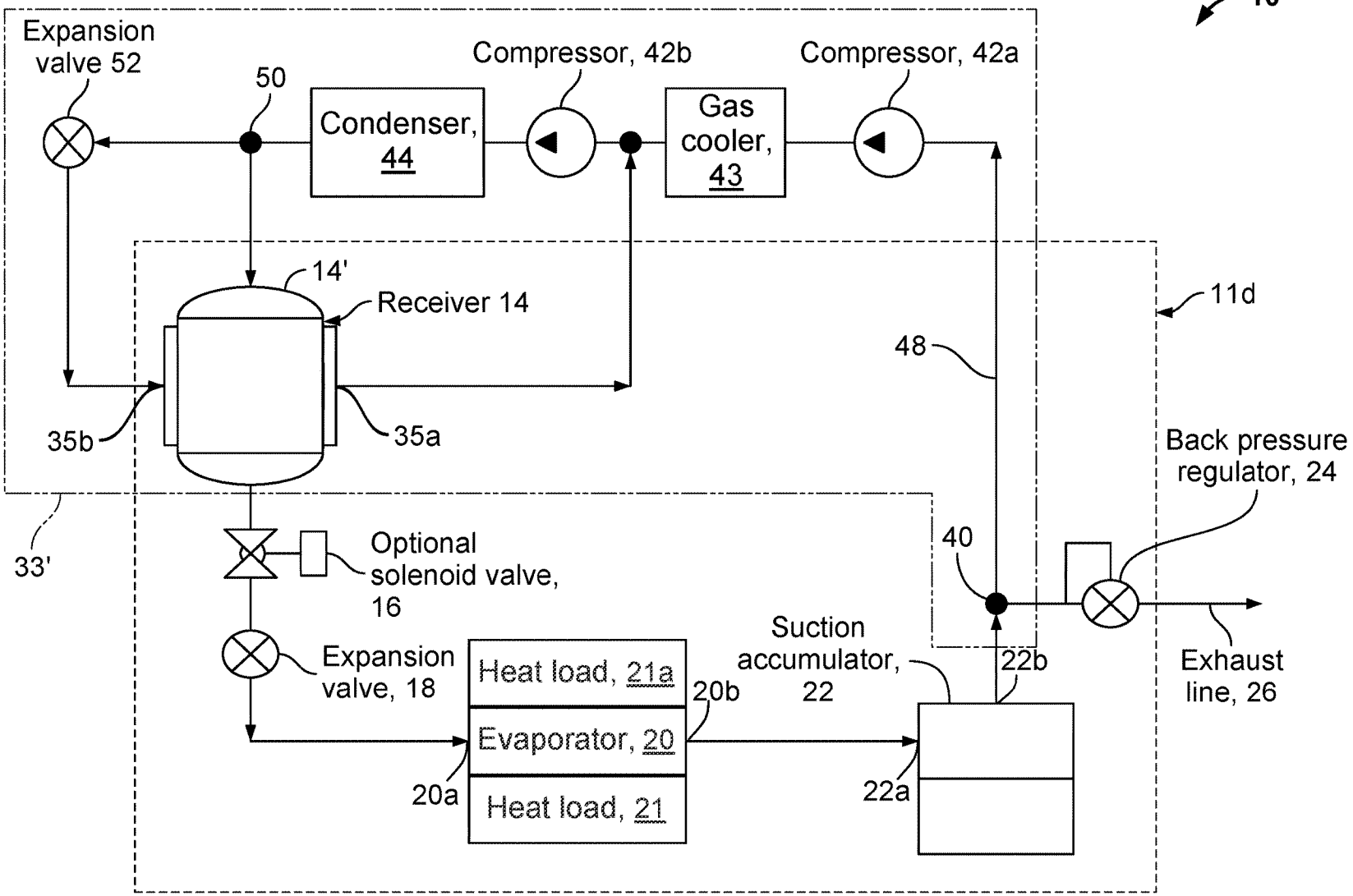
FIG. 4A is a schematic diagram of a TMS that includes an OCRS with a refrigerant receiver and a cooler, which is integrated with an alternative closed-circuit refrigeration system.

Referring now to FIG. 4A, TMS 10 includes a closed-circuit cooling system 33' having an alternative, two-stage vapor cycle system (VCS) that includes a first-stage compressor 42*a*, a gas cooler 43, a second-stage compressor 42*b*, and the condenser 44, in addition to the receiver 14, the optional solenoid valve 16, the expansion valve 18, the evaporator 20, and the suction accumulator 22. The two-stage vapor-cycle system also includes the additional circuit that includes the expansion valve 52 that feeds vapor to the receiver shell 14', e.g., an evaporator integrated with the receiver 14 for cooling the receiver 14.

The different ways of integrating the evaporator 20 and the receiver 14 are described above. The condenser 44 and the gas cooler 43 may be configured either as air-cooled or water-cooled heat rejection exchangers. A back-pressure regulator 24 at the exhaust line 26 establishes the open-circuit refrigeration system operation.

The closed-circuit cooling system 33' is integrated with the OCRS which includes the receiver 14, the optional solenoid valve 16, the expansion valve 18, the evaporator 20, the suction accumulator 22, the back-pressure regulator 24 and the exhaust line 26.

The VCS operates in a few modes.

In one mode, which can be considered as a stand-by mode, a closed circuit including the second-stage compressor 42*b*, the condenser 44, and the expansion valve 52 cools the refrigerant in the receiver 14. The colder refrigerant is the less mass flow rate is required during open-circuit operation.

In another mode, a house-keeping mode, the first-stage compressor 42*a* compresses the refrigerant vapor to an intermediate pressure. In the gas cooler 43, the refrigerant is cooled to a temperature close to (but higher than) ambient temperature. Refrigerant that exits the gas cooler 43 mixes with the refrigerant stream that exits the receiver shell 14' (evaporator) that is integrated with the receiver 14, to further cool that refrigerant stream. The second-stage compressor 42*b* compresses the refrigerant at the intermediate pressure to the condensing pressure. As used herein "intermediate pressure" is a pressure value that is defined as being between the pressure value of the refrigerant at the inlet of the first-stage compressor 42*a*, i.e., at the vapor-side outlet 22*b* of the suction accumulator 22, and the condensing pressure.

In the condenser 44, the refrigerant is condensed and enters the receiver 14. Liquid refrigerant is expended in the expansion valve 18 at a constant enthalpy, turns into two-phase mixture and enters the evaporator 20. The liquid portion evaporates in the evaporator 20. If the expansion valve 18 is configured to control a superheat at the evaporator exit 20*b*, then there is no need for the suction accumulator 22. However, if the evaporator 20 is configured to operate in the two-phase region with an exit vapor quality below the critical one, the suction accumulator 22 will capture the liquid refrigerant exiting the evaporator 20. When the cooling cycle is completed, a pump-down cycle can be used to return any liquid accumulated in the suction accumulator 22 back to the receiver 14. At the same time a portion of the liquid refrigerant exiting the condenser 44 is used to cool the receiver 14 via the evaporator integrated with receiver 14. The expansion valve 18 is configured to operate either in superheat or in vapor quality modes.

Any one or both of the compressors 42*a*, 42*b* can be configured as variable speed devices. The second-stage compressor 42*b* may operate at low speed in the first mode to enable operation of the evaporator integrated with the receiver with a superheat. The high speed may be applied in the housekeeping mode to provide a vapor quality at the evaporator exit. The expansion valve 52 is configured accordingly.

When the ambient temperature is low, the second-stage compressor 42*b* may stay OFF in the housekeeping mode, and the first-stage compressor 42*a* will push the compressed refrigerant vapor through the second-stage compressor.

A third mode engages the open circuit components and operates with or without the CCRS.

The CCRS can include an evaporator arrangement (evaporator 20) with detailed examples shown in FIGS. 4B-4E, e.g., multiple evaporators, and can include the optional solenoid valve 16 that can be used when the expansion valve 18 is not configured to completely stop refrigerant flow when the TMS 10 is in an OFF state.

Referring now to FIGS. 4B-4E evaporator arrangements that are alternative configurations of the evaporator 22 and heat loads 21, 21*a* are shown.

Figure 4C:
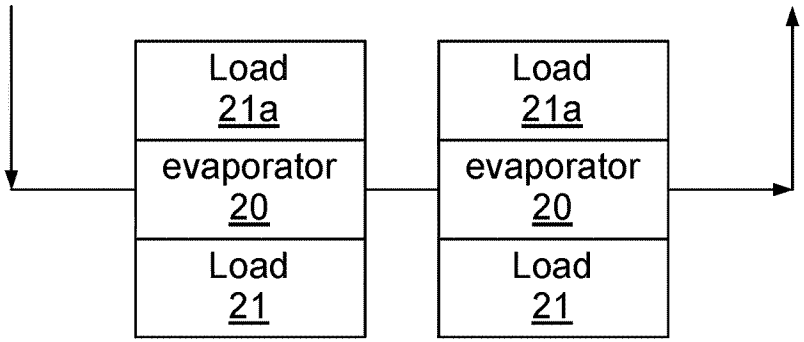
FIGS. 4B-4E are schematics of alternative configurations of the evaporator.
Figure 4B:
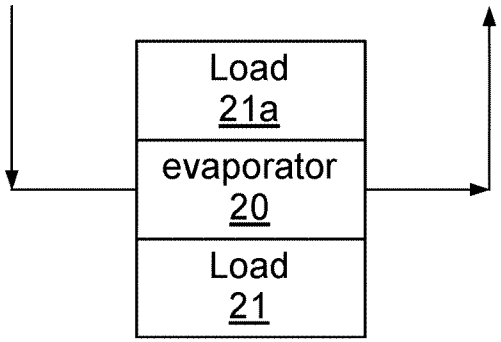

In the configuration of FIG. 4B, both the low heat load 21*a* and the high heat load 21 are coupled to (or are in proximity to) a single, i.e., the same, evaporator 20.

In the configuration of FIG. 4C, each of a pair of evaporators 20 have the low heat load 21*a* and the high heat load 21 coupled or proximate thereto. In an alternative configuration of FIG. 4C, (not shown), the low heat load 21*a* would be coupled (or proximate) to a first one of the pair of evaporators 20 and the high heat load 21 would be coupled (or proximate) to a second one of the pair of evaporators 20.

Figure 4E:
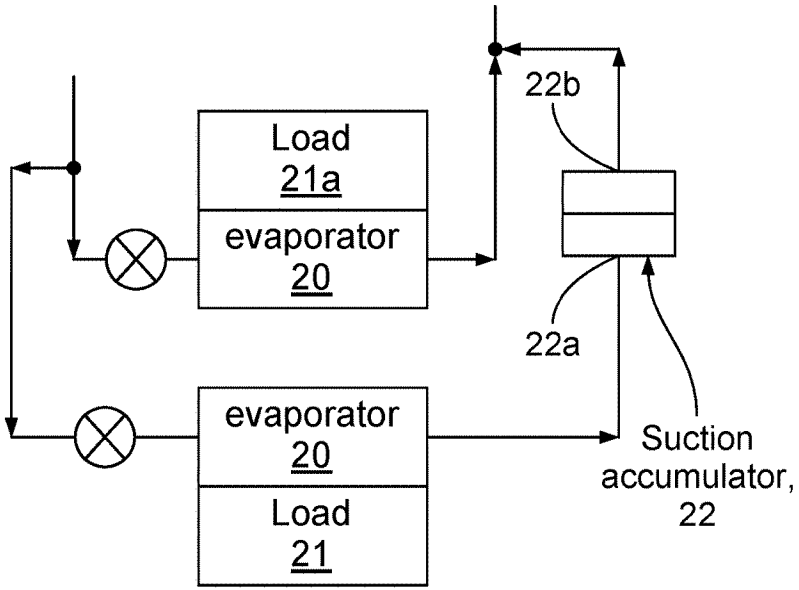
Figure 4D:
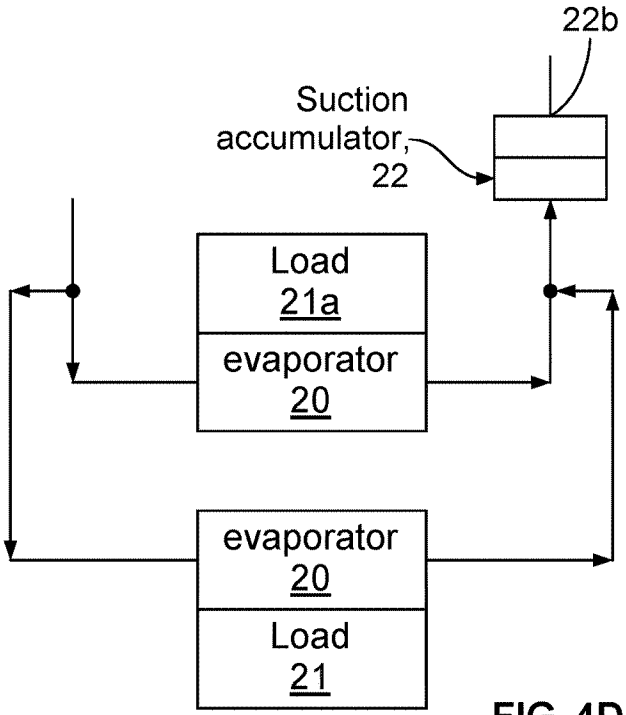

In the configurations of FIGS. 4D and 4E, the low heat load 21*a* and the high heat load 21 are coupled (or proximate) to corresponding ones of the pair of evaporators 20. In the configurations of FIGS. 4D and 4E, a T-valve (not referenced, passive or active), as shown, splits refrigerant flow into two paths that feed two evaporators 20. One of the evaporators 20 is coupled (or proximate) to the low heat load 21*a* and the other of these evaporators 20 is coupled (or proximate to) the high heat load 21. As also shown in FIG. 4E, expansion valves are coupled at inlet sides of the evaporators 20. At least one expansion valve would be configured to control a vapor quality at the evaporator 20 exit to allow discharging liquid into the suction accumulator 22, while the other would control a superheat. Other configurations are possible.

In the configuration of FIG. 4D, the outputs of the evaporators 20 are coupled to a second T-valve (not referenced, active or passive) that has an output that feeds the inlet 22*a* of the suction accumulator 22.

On the other hand, in the configuration of FIG. 4E, the outputs of the evaporators 20 are coupled differently. The output of the evaporator 20 that has low heat load 21*a* feeds an inlet of the second T-valve, whereas the output of the evaporator 20 that has high heat load 21 feeds inlet 22*a* of the suction accumulator 22. This arrangement, in effect, removes the suction accumulator 22 from the closed-circuit cooling system portion. In some configurations, the T-valves can be switched (meaning that they can be controlled (automatically or manually) to shut off either or both inlets) or passive meaning that they do not shut off either inlet and thus can be T junctions.

Expansion devices such as expansion valve 18 can be implemented as a fixed orifice, a capillary tube, and/or a mechanical or electronic expansion valve. In general, fixed orifices and capillary tubes are passive flow restriction elements which do not actively regulate refrigerant fluid flow.

Mechanical expansion valves (usually called thermostatic or thermal expansion valves) are typically flow control devices that enthalpically expand a refrigerant fluid from a first pressure to an evaporating pressure, controlling the superheat at the evaporator exit. Mechanical expansion valves generally include an orifice, a moving seat that changes the cross-sectional area of the orifice and the refrigerant fluid volume and mass flow rates, a diaphragm moving the seat, and a bulb at the evaporator exit. The bulb is charged with a fluid and it hermetically fluidly communicates with a chamber above the diaphragm. The bulb senses the refrigerant fluid temperature at the evaporator exit (or another location) and the pressure of the fluid inside the bulb, transfers the pressure in the bulb through the chamber to the diaphragm, and moves the diaphragm and the seat to close or to open the orifice.

Typical electrical expansion valves include an orifice, a moving seat, a motor or actuator that changes the position of the seat with respect to the orifice, a controller 17, and pressure and temperature sensors at the evaporator exit. The controller 17 calculates the superheat for the expanded refrigerant fluid based on pressure and temperature measurements at the evaporator exit. If the superheat is above a set-point value, the seat moves to increase the cross-sectional area and the refrigerant fluid volume and mass flow rates to match the superheat set-point value. If the superheat is below the set-point value, the seat moves to decrease the cross-sectional area and the refrigerant fluid flow rates.

Examples of suitable commercially available expansion valves that can function as expansion valves 18 include, but are not limited to, thermostatic expansion valves available from the Sporlan Division of Parker Hannifin Corporation (Washington, MO) and from Danfoss (Syddanmark, Denmark).

Ejector-Assisted Configurations

Figure 5A:
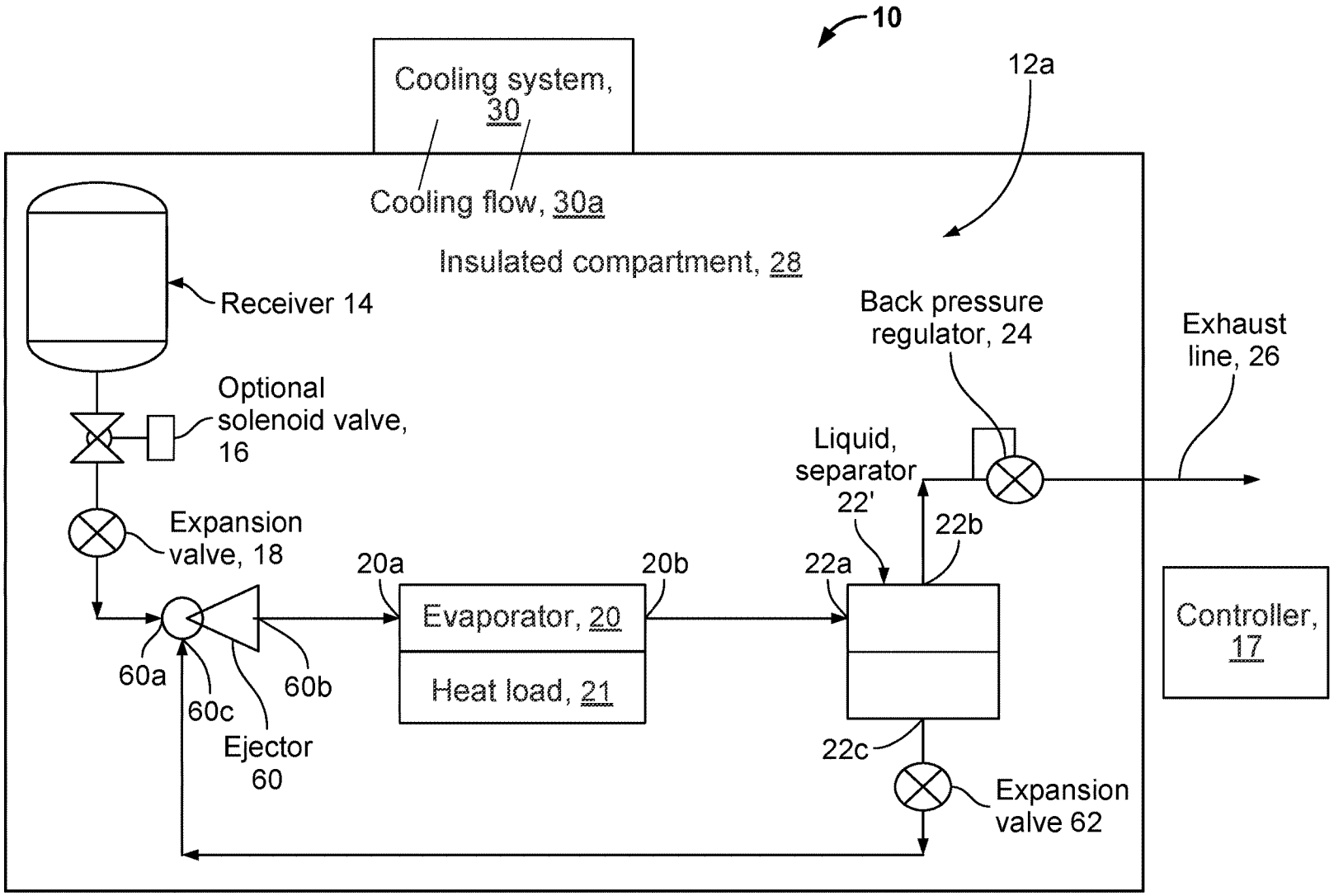
FIGS. 5A-5G are schematic diagrams of ejector configurations.

Referring now to FIG. 5A, a thermal management system 10 includes an open-circuit refrigeration system, with ejector boost (OCRS-E) 12*a*. OCRS-E 12*a* includes the refrigerant receiver 14 and may include the optional solenoid control valve 16, an expansion valve 18, the evaporator 20 and a liquid separator 22' that has in addition to the inlet 22*a* and the vapor-side outlet 22*b* of the suction accumulator 22, a liquid-side outlet 22*c*. The control device 24 (e.g., back-pressure regulator) is coupled to the vapor-side outlet 22*b* of the liquid separator 22'. Also included is an ejector 60. The ejector 60 has a primary inlet 60*a* that is coupled to an outlet of the expansion valve 18 and has an outlet 60*b* that is coupled to the inlet 20*a* of the evaporator 20. The ejector 60 also includes a secondary inlet 60*c* that is coupled, via a second expansion valve 62, to a liquid side outlet 22*c* of the liquid separator 22'.

The foregoing are coupled via conduits (not referenced) and generally are similar to the embodiment of FIG. 1, except for the addition of the ejector 60 and second expansion valve 62. A heat load 21 is thermally coupled to (or in close proximity with) the evaporator 20.

OCRS-E 12*a* stores liquid refrigerant in the receiver 14. The liquid refrigerant in receiver 14 is fed from the receiver 14 into the evaporator inlet 20*a* and to the evaporator 20 where evaporation occurs at a certain (evaporating) pressure and temperature. The heat load 21 demand on the evaporator 20 and the pumped mass flow rate define vapor quality of the refrigerant at the evaporator outlet 20*b*, as discussed for FIG. 1.

In order to extend the useful life of OCRS-E 12*a*, cooling of the refrigerant is provided. Cooling of the refrigerant is provided by a coolant medium or cooling fluid that is flowed over and/or through at least the refrigerant receiver 14.

In a first example, the OCRS-E 12*a* includes a cooling arrangement embodied as an insulated container or compartment 28 and cooling is provided by a cooling system 30 that is external to the container or compartment 28. OCRS-E 12*a* uses the cooling system 30 to cool the liquid refrigerant in the liquid refrigerant receiver 14. This makes the OCRS lighter and more compact than a comparable closed-circuit refrigeration system of comparable cooling capacity. The cooling arrangement is generally as discussed above for FIG. 1.

In some embodiments, refrigerant flow through the OCRS-E 12*a* is controlled either solely by the ejector 60 and the back-pressure regulator 24 or by those components aided by either one or all of the solenoid valve 16, expansion valve 18, and expansion valve 62, depending on requirements of the application, e.g., ranges of mass flow rates, cooling requirements, receiver capacity, ambient temperatures, thermal load, etc.

While both solenoid valve 16 and expansion valve 18 may not be used, in some implementations either or both would be used and would function as flow control devices to control refrigerant flow into the primary inlet 60*a* of the ejector 60. In some embodiments, expansion valve 18 can be integrated with the ejector 60. The optional solenoid valve 16 may be required under some circumstances where there are or can be significant changes in, e.g., an ambient temperature, which might impose additional control requirements on the OCRS-E 12*a*.

The back-pressure regulator 24 at the vapor side outlet 22*b* of the liquid separator 22' generally functions to control the vapor pressure upstream of the back-pressure regulator 24. In OCRS-E 12*a*, the back-pressure regulator 24 is a control device that controls the refrigerant fluid vapor pressure from the liquid separator 22, and indirectly controls evaporating pressure/temperature. The evaporator 20 is coupled in a fluid flow path with the secondary inlet 60*c* (low-pressure inlet) of the ejector 60 and the outlet of the second expansion valve 62, such that the second expansion valve 62 and conduit couple the evaporator 20 to the liquid side outlet 22*c* of the liquid separator 22'. In this configuration, the ejector 60 acts as a "pump," to "pump" a secondary fluid flow, e.g., liquid from the liquid separator 22' using energy of the primary refrigerant flow from the refrigerant receiver 14.

Other configurations can include two (or three evaporators), as described in FIG. 5E (below).

Figure 5B:
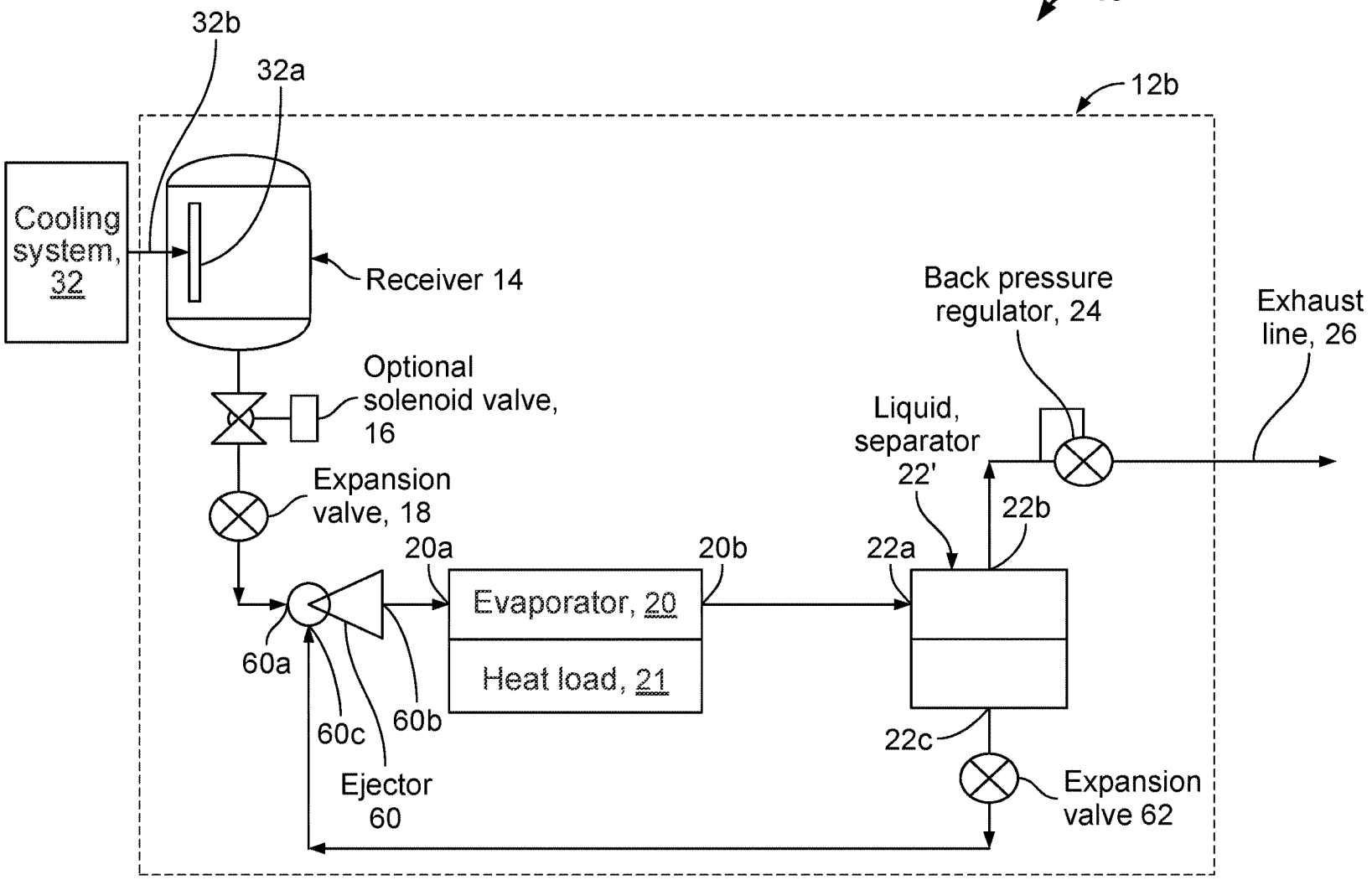

Referring now to FIG. 5B, the TMS 10 includes an OCRS with ejector-boost (OCRS-E) 12*b*. OCRS-E 12*b* includes the elements of FIG. 2 and also includes the ejector 60, with the primary inlet 60*a* coupled to the outlet of the expansion valve 18 and the outlet 60*b* coupled to the inlet 20*a* of the evaporator 20. The ejector 60 also includes the secondary inlet 60*c* that is coupled, via a second expansion valve 62, to a liquid side outlet 22*c* of the liquid separator 22'.

In some embodiments, refrigerant flow through the OCRS-E 12*b* is controlled either solely by the ejector 60 and the back-pressure regulator 24 or by those components aided by either one or all of the solenoid valve 16, expansion valve 18, and expansion valve 62, depending on requirements of the application, e.g., ranges of mass flow rates, cooling requirements, receiver capacity, ambient temperatures, thermal load, etc., as discussed above for FIG. 5A. OCRS-E 12*b* includes the cooling system 32 that includes the cooling heat exchanger or evaporator 32*a* disposed within the receiver 14. The cooling system 32 provides a temperature-controlled environment within the receiver 14 to cool the liquid refrigerant in the receiver by the cooling fluid 32*b* that is flowed through the cooling heat exchanger 32*a* within the refrigerant receiver 14. The refrigerant contacts the cooling heat exchanger 32*a* drawing heat from the refrigerant in the receiver 14.

Figure 5C:
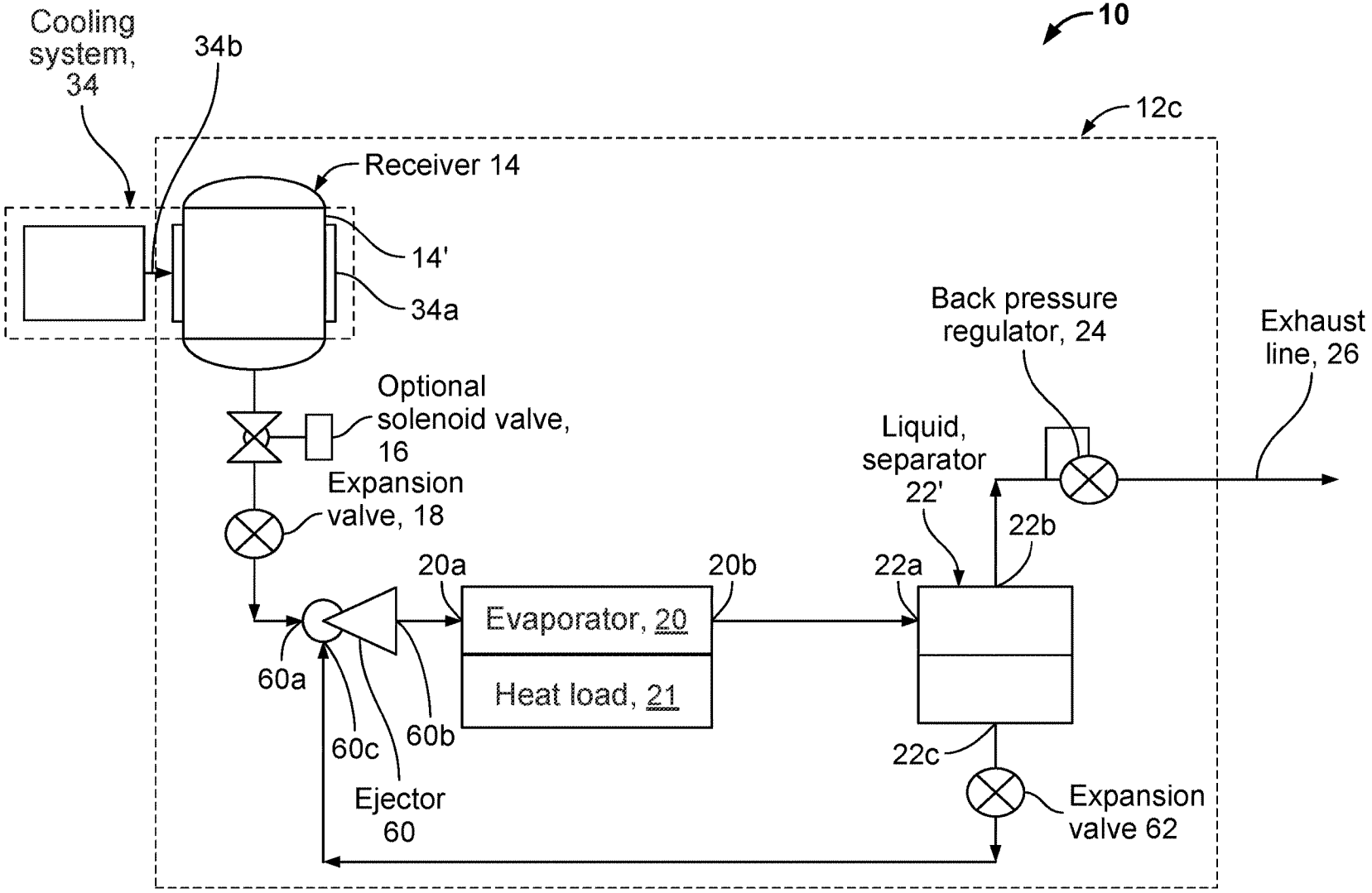

Referring to FIG. 5C, the TMS 10 includes an OCRS with ejector (OCRS-E) 12*c*. This system is similar to OCRS 11*c* (FIG. 3) including the cooling system 34 and the ejector 60. The ejector 60 has the primary inlet 60*a* coupled to the outlet of the expansion valve 18 and has the outlet 60*b* coupled to the inlet 20*a* of the evaporator 20, and generally operates as in either FIG. 5A or 5B. FIG. 5C uses the alternative cooling system 34 that includes the cooling heat exchanger or evaporator 34*a* embedded within or about the shell portion 14' of the receiver 14. The cooling system 34 provides a temperature-controlled environment within the receiver 14. Cooling of the liquid refrigerant is provided by cooling fluid 34*b* that is flowed within the shell 14' of the refrigerant receiver 14, and which draws heat from the refrigerant in the receiver 14.

Figure 5D:
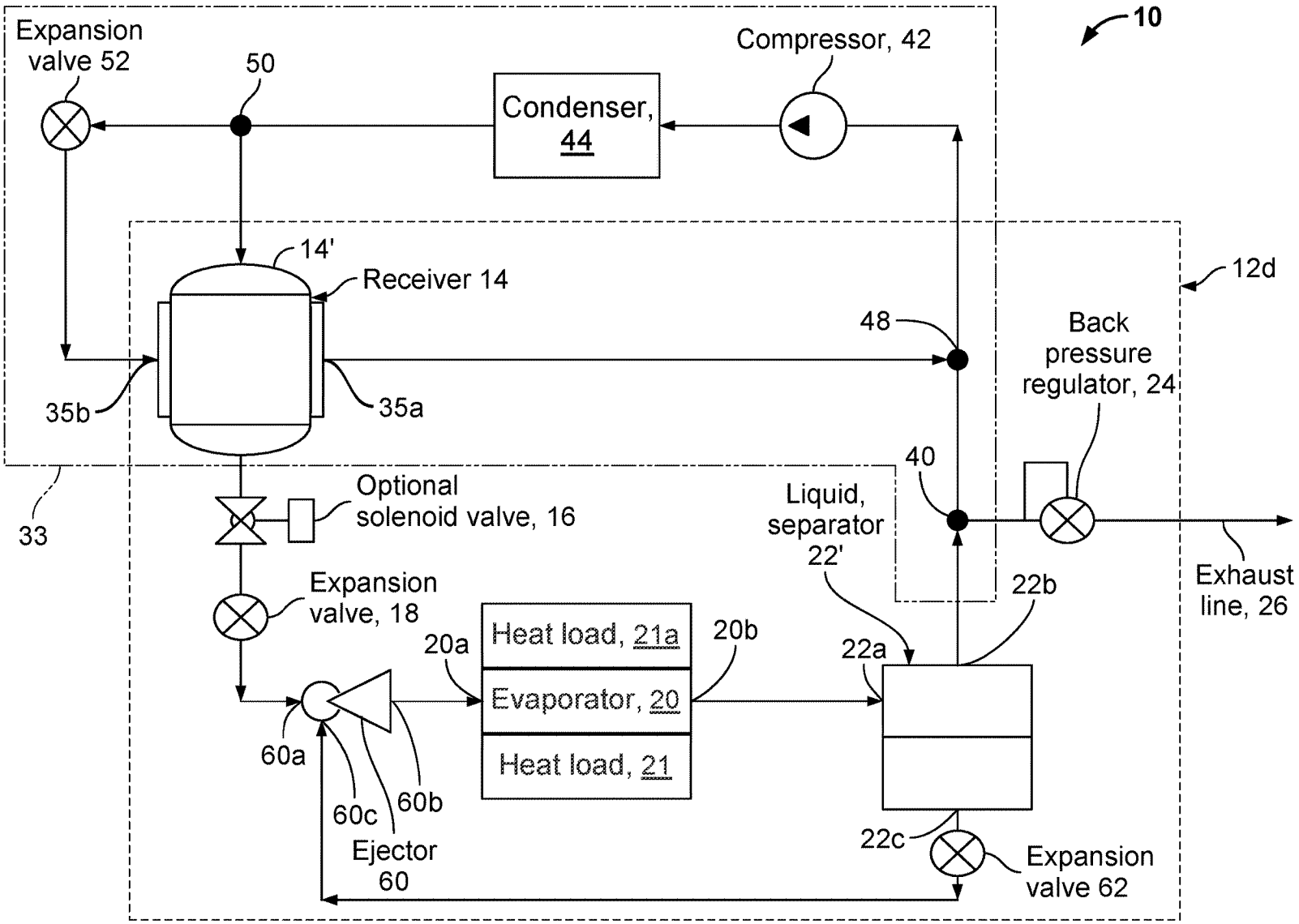

Referring to FIG. 5D, the TMS 10 includes an OCRS with ejector (OCRS-E) 12*d*. This system is similar to OCRS-E 11*d* (FIG. 4) including the integrated CCRS 33 and the ejector 60. The ejector 60 has the primary inlet 60*a* coupled to the outlet of the expansion valve 18 and has the outlet 60*b* coupled to the inlet 20*a* of the evaporator 20, and generally operates as in either FIG. 5A or 5B.

OCRS-E 12*d* includes the integrated closed-circuit cooling system 33 that comprises the receiver 14, the first junction 40 with the inlet coupled to the vapor side outlet 22*b* of the liquid separator 22', and the first and second junction outlets. One junction outlet is coupled to the inlet to the back-pressure regulator 24 and the other junction outlet is coupled to the inlet of the second junction 48, as in FIG. 4. The second inlet of the second junction 48 is coupled to an outlet 35*a* of the receiver shell (or jacket) 14', and the outlet of the junction 48 is coupled to the inlet of the compressor 42, with the compressor outlet coupled to the inlet of the condenser 44, with the condenser outlet coupled to the inlet of the third junction 50. The first outlet of the third junction 50 is coupled to the inlet of the receiver 14, whereas the second outlet of the third junction 50 is coupled to the second expansion valve 52. The outlet of the second expansion device 52 is coupled to the inlet 35*b* of the receiver shell 14'. The outlet of the receiver 14 is coupled to the optional solenoid valve 16.

In this configuration, the addition of the compressor 42 and condenser 44 provides a closed loop path that is used to cool the refrigerant liquid in the receiver 14, prior to entering the primary inlet of the ejector 60. The condenser 44 provides the coolant medium or cooling fluid that is flowed about the refrigerant receiver 14 and contacts the receiver shell 14' that functions as a cooling heat exchanger that draws heat from the refrigerant in the receiver 14.

In this configuration, the closed-circuit cooling system can be used to cool first heat load 21 and second heat load 21*a*, as in FIG. 4. The second heat load 21*a* can be in proximity to the evaporator 20. First heat load 21 is generally a high heat load, i.e., a high heat flux load that is highly temperature sensitive, whereas heat load 21*a* is a low heat load, i.e., a low heat flux load that is less temperature sensitive relative to high heat load 21. The low heat load 21*a* is cooled by operation of the closed-circuit refrigeration system, with the back-pressure regulator 24 placed in an "OFF" state, whereas the high heat load is cooled by operation of the closed-circuit refrigeration system, with the back-pressure regulator 24 placed in an "ON" state.

The CCRS can include an evaporator arrangement (evaporator 20) with detailed examples shown in FIGS. 4B-4E, e.g., multiple evaporators, and can include the optional solenoid valve 16 that can be used when the expansion valve 18 is not configured to completely stop refrigerant flow when the TMS 10 is in an OFF state.

Figure 5E:
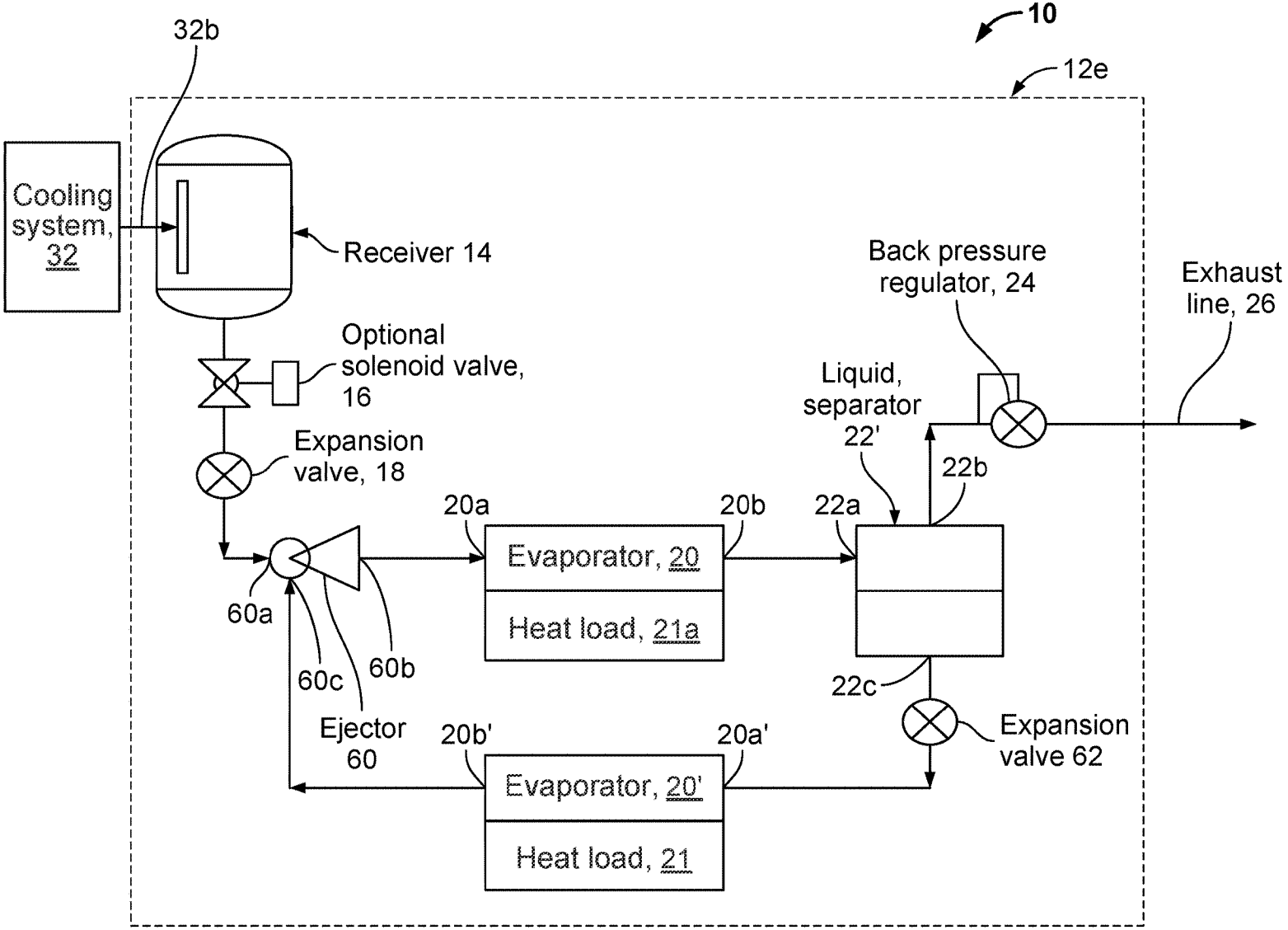

Referring to FIG. 5E, the TMS 10 includes an OCRS with ejector (OCRS-E) 12*e*. This system is similar to OCRS-E 12*b* (FIG. 5B) and is emblematic of any of FIGS. 5A to 5D but includes a second evaporator 20' (and a second heat load 21*a*) that has an inlet 20*a'* coupled to the liquid side outlet 22*c* of the liquid separator 22' and has an evaporator outlet **20*b*' coupled to the secondary inlet of the ejector 60. This configuration with two evaporators has the evaporator 20, as shown, being fed via the outlet 60*b* of the ejector 60 and has the second evaporator 20' receiving refrigerant from the outlet of the second expansion valve 62 and with the second evaporator outlet 20*b*' feeding the secondary inlet 60*c* of the ejector 60. In addition, a third evaporator can be coupled to the second expansion valve 62 outlet and operate under superheat with or without superheat control. Other embodiments of FIGS. 5A, 5C and 5D can also be used. In some embodiments, each of the evaporators 20 and 20' can include heat loads 20, 20*a***.

Figure 5F:
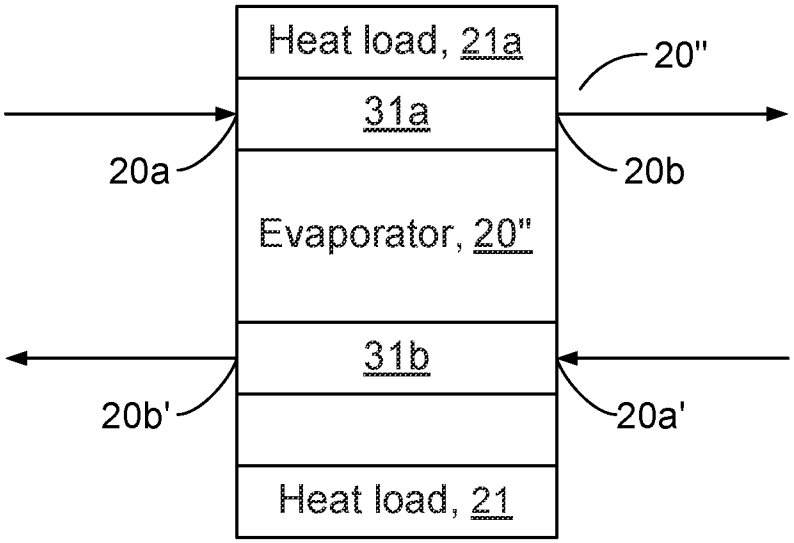

Referring now to FIG. 5F, which shows a single evaporator 20" with heat loads 20, **20*a* and a pair of refrigerant fluid paths 31*a*, 31*b*. Path 21*a* is between inlet 20*a* and outlet 20*b* and path 21*b* is between inlet 20*a*' and 20*b*'. A single evaporator 20" with dual paths can be used for either the embodiments of FIG. 5D, or FIG. 6D (discussed below) and variants of FIGS. 5D and 6**D.

Figure 5G:
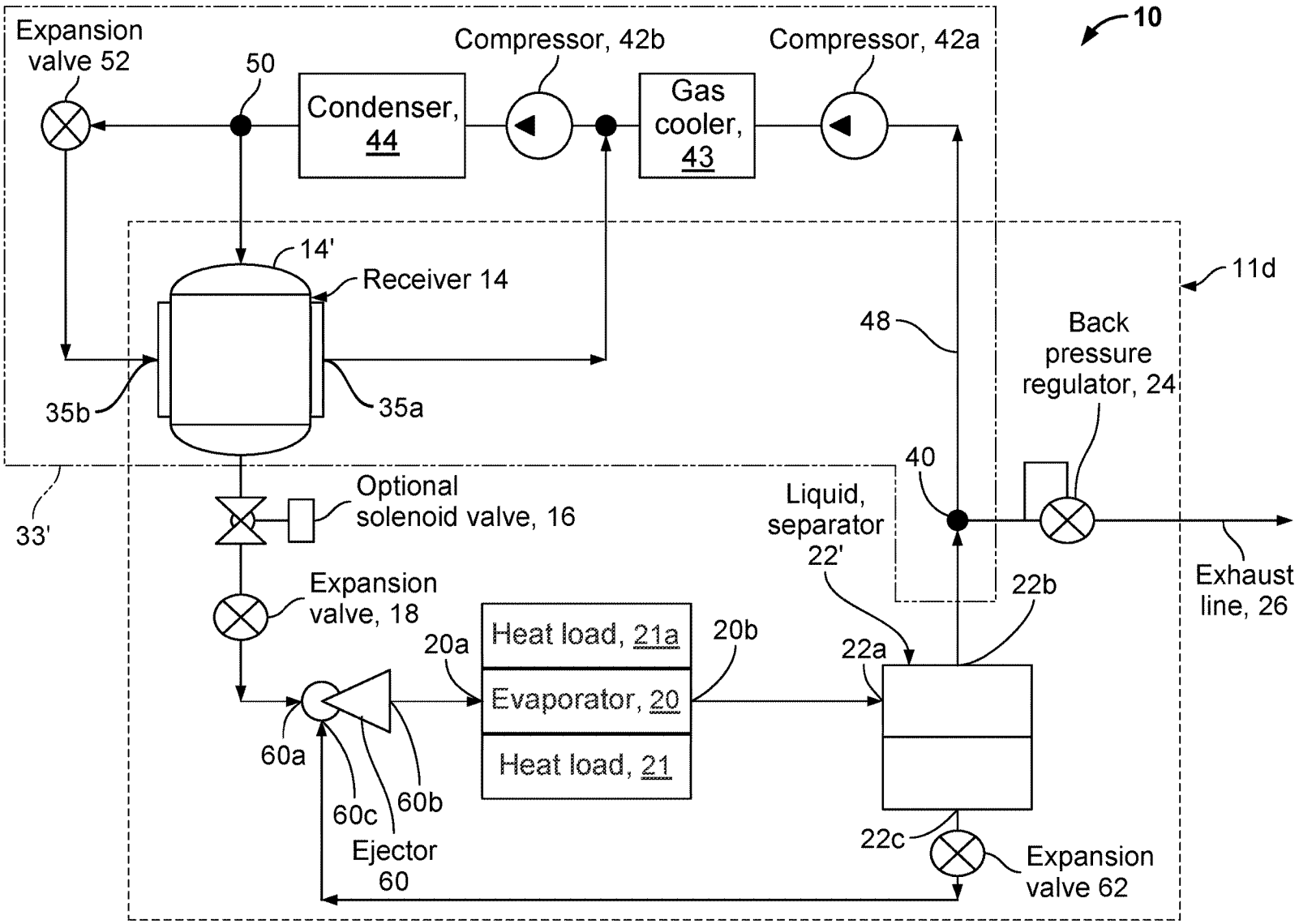

Referring now to FIG. 5G, this system is similar to that discussed in FIG. 4D but for the use of the ejector 60, with the evaporator 20, liquid separator 22', and expansion valve 52. Operation is similar to that discussed in FIG. 4D as modified by the ejector 60 and thus also similar to that discussed in FIG. 5D.

Figure 6:
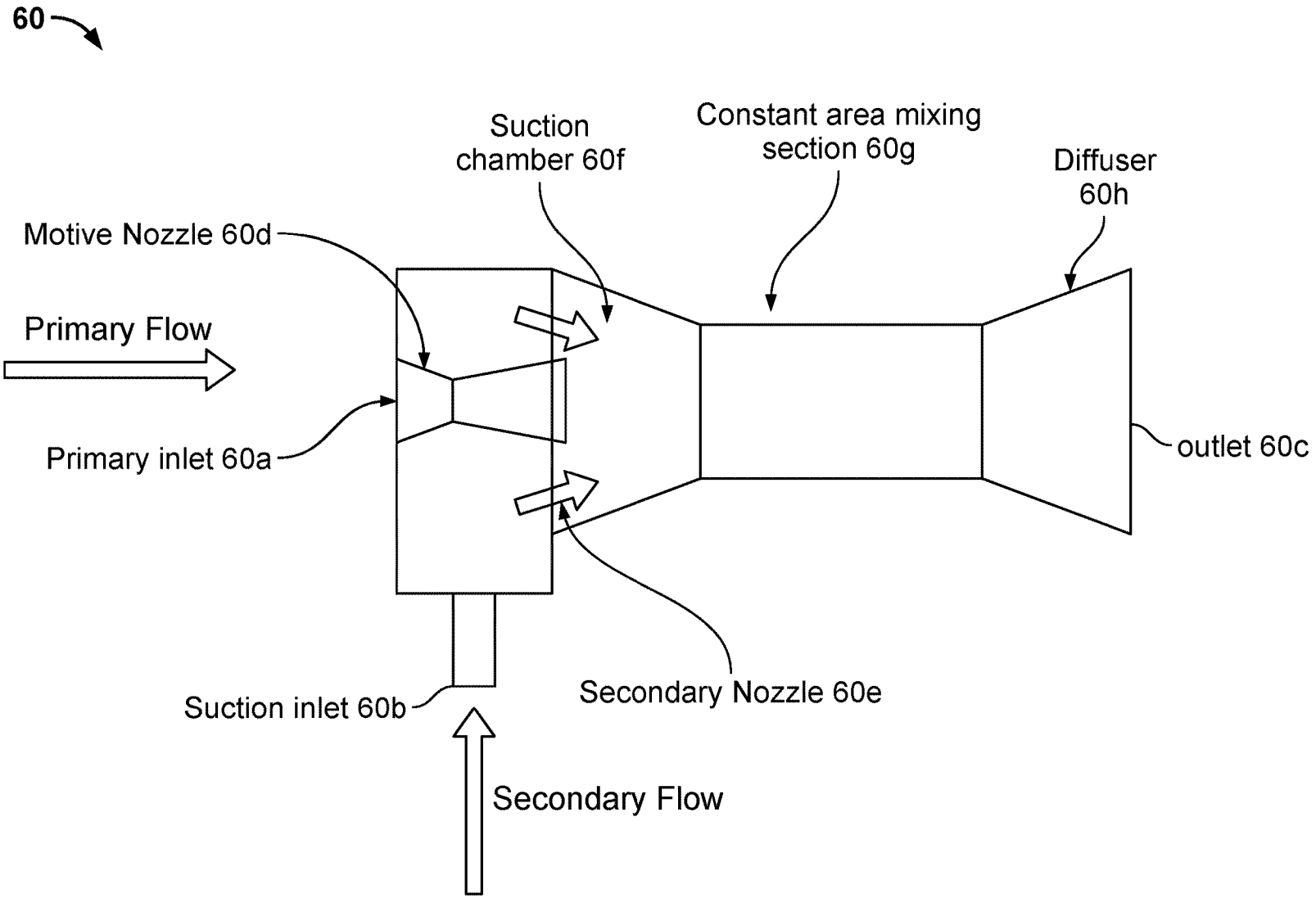
FIG. 6 shows an example of an ejector.

Referring now also to FIG. 6, a typical configuration for the ejector 60 is shown. This exemplary ejector 60 includes the primary inlet **60*a*, the secondary or suction inlet 60*b* and the outlet 60*c*. The primary inlet 60*a* feeds a motive nozzle 60*d*, the secondary or suction inlet 60*b* feeds one or more secondary nozzles 60*e* that are coupled to a suction chamber 60*f*. A mixing chamber 60*g* of a constant area receives the primary flow of refrigerant and secondary flow of refrigerant and mixes these flows. A diffuser 60*h* diffuses the flow to deliver an expanded flow at the outlet 60*c***.

Liquid refrigerant from the receiver is the primary flow. In the motive nozzle **60*d* potential energy of the primary flow at the inlet 60*a* is converted into kinetic energy reducing the potential energy (the established static pressure) of the primary flow. The secondary flow at the inlet 60*b* from the outlet of the evaporator 20 has a pressure that is higher than an established static pressure in the suction chamber 60*f*, and thus the secondary flow is entrained through the suction inlet (secondary inlet 60*b*) and the secondary nozzles 60*f* internal to the ejector 60. The two streams (primary flow and secondary flow) mix together in the mixing section 60*g*. In the diffuser section 60*h*, the kinetic energy of the mixed streams is converted into potential energy elevating the pressure of the mixed flow liquid/vapor refrigerant that leaves the ejector outlet 60*c* and is fed to the liquid separator 22'**.

In the context of the ejector assisted open-circuit refrigeration configurations (FIGS. 5A-5E discussed above), the use of the ejector 60 allows for recirculation of liquid refrigerant captured by the liquid separator 22' to increase the efficiency of TMS 10. That is, by allowing some passive recirculation of refrigerant liquid, apart from the operation of the compressor 42 and the condenser 44, as in conventional closed-circuit refrigeration system, this recirculation reduces the required amount of refrigerant needed for a given amount of cooling over a given period of operation and can also reduce both the power and size requirements for the compressor/42 and condenser 44 for a given amount of cooling/heating capacity.

Pump-Boost Configurations

Figure 7A:
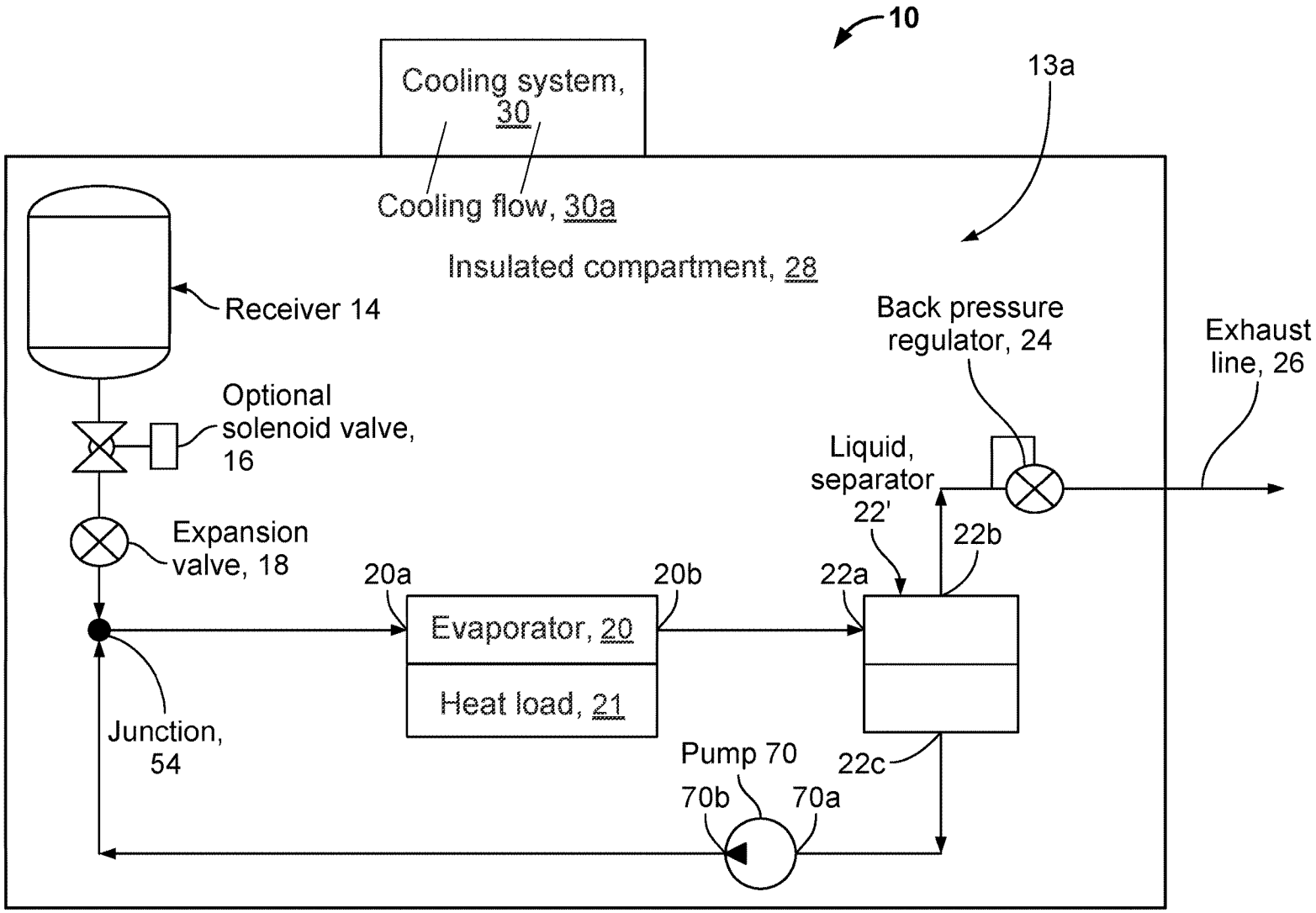
FIGS. 7A-7F are schematic diagrams showing pump configurations.

Referring to FIG. 7A, the TMS 10 includes an alternative OCRS **13*a*. OCRS 13*a* includes the elements of FIG. 1 arranged as in FIG. 1 and also includes a pump 70 and a liquid separator 22' rather than a suction accumulator 22. The pump 70 has a pump inlet 70*a* that is coupled to a liquid-side outlet 22*c* of the liquid separator 22'. The pump 70 also has a pump outlet 70*b* that is coupled to an inlet of a junction 54. In FIG. 7A, the evaporator 20 inlet 20*a* is coupled to an outlet of the junction 54 and the evaporator 20 outlet 20*b* is coupled to the inlet 22*a* of the liquid separator 22'. A second inlet of the junction device 54 is coupled to an outlet of the expansion valve 18**.

The OCRS **13*a* also includes the cooling arrangement embodied as the insulated container or compartment 28, with cooling provided by the cooling system 30 that is external to the container or compartment 28. The cooling system 30 provides a cooling fluid 30*a* over the receiver 14 and the other features of the OCRS 13*a* except for the exhaust line 26, which is external to the container or compartment 28**.

The cooling system 30 cools the liquid refrigerant in the liquid refrigerant receiver 14. This makes the OCRS lighter and more compact than a comparable closed-circuit refrigeration system of comparable cooling capacity. The cooled liquid refrigerant from the refrigerant receiver 14 is expanded in the expansion valve 18 turning the liquid into a two-phase mixture. This two-phase mixture is mixed with an amount of pumped refrigerant from the pump 70 in the junction 54, and is fed to the evaporator 20. The evaporator 20 absorbs heat from the heat load 21 converting a portion of the mixed refrigerant into a liquid/vapor mixture that exits the evaporator 20 and enters the liquid separator 22', which separates the liquid/vapor mixture into a liquid refrigerant and a vapor refrigerant. The liquid refrigerant exiting the liquid separator 22' is pumped by the pump 70 back into the evaporator 20 via the junction device 54. In this configuration, the pump 70 pumps a secondary refrigerant fluid flow, e.g., a recirculation liquid refrigerant flow from the evaporator 20, via the liquid separator 22', back into the evaporator 20.

Other configurations can include two or three evaporators, as discussed in FIG. 6E.

In addition, still other configurations include positioning of the junction device 54 prior to the inlet to the expansion valve 18 such that pumped liquid refrigerant passes through the expansion valve 18 together with liquid refrigerant that is received from the receiver 14. These configurations can also include two or three evaporators.

Various types of pumps can be used for pump 70. Exemplary pump types include gear, centrifugal, rotary vane, etc. When choosing a pump, the pump should be capable to withstand the expected fluid flows, including criteria such as temperature ranges for the fluids, and materials of the pump should be compatible with the properties of the fluid. A subcooled refrigerant can be provided at the pump 70 outlet to avoid cavitation. To do that a certain liquid level in the liquid separator 22' may provide hydrostatic pressure corresponding to that sub-cooling.

Figure 7B:
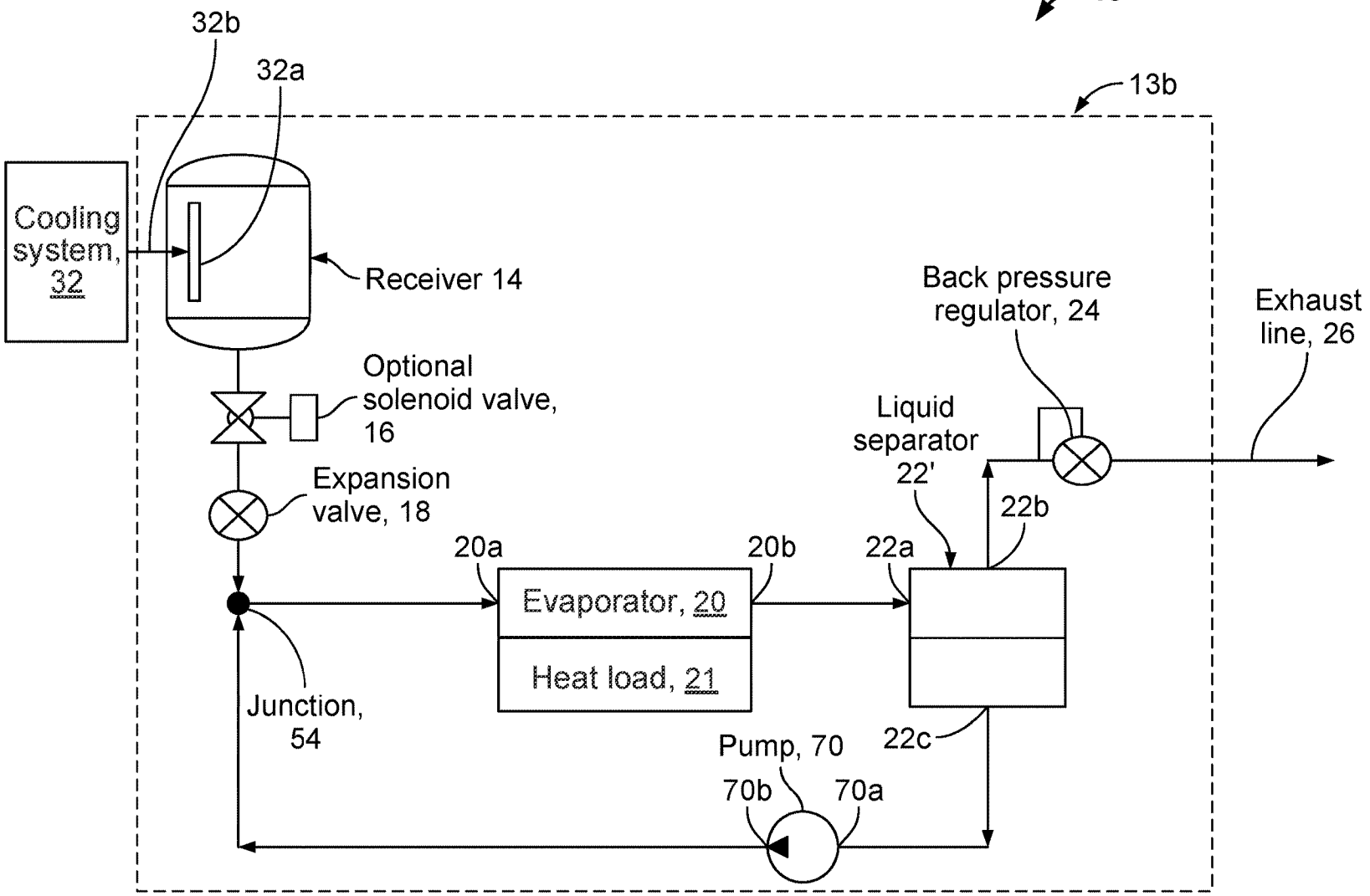

Referring to FIG. 7B, the TMS 10 includes an alternative OCRS **13*b*. OCRS 13*b* includes the elements of FIG. 2 arranged as in FIG. 2. Also included is the pump 70. The pump 70 has the pump inlet 70*a* coupled to the liquid-side outlet 22*c* of the liquid separator 22'. The pump 70 also has the pump outlet 70*b* coupled to the inlet of the junction 54. In FIG. 7B, the evaporator inlet 20*a* is coupled to an outlet of the junction 54 and the evaporator outlet 20*b* is coupled to the inlet 22***a* of the liquid separator 22'. A second inlet of the junction device 54 is coupled to an outlet of the expansion valve 18.

OCRS 13*b* includes the cooling system 32 including the cooling heat exchanger or evaporator 32*a* disposed within the receiver 14. The features of OCRS 13*b* are otherwise as discussed in FIG. 1. The cooling system 32 provides the temperature-controlled environment within the receiver 14. Cooling of the liquid refrigerant is provided by the cooling fluid 32*b* that is flowed through the cooling heat exchanger 32*a* within the refrigerant receiver 14. The refrigerant can contact the cooling heat exchanger 32*a* drawing heat from the refrigerant in the receiver 14.

The liquid refrigerant from the refrigerant receiver 14 is expanded in the expansion valve 18 turning the liquid into a two-phase mixture. This two-phase mixture is mixed with an amount of pumped refrigerant from the pump 70 in the junction 54, and is fed to the evaporator 20. The evaporator absorbs heat from the heat load 21 converting a portion of the mixed refrigerant into a liquid/vapor that exits the evaporator 20 and enters the liquid separator 22'. The liquid stream exiting the liquid separator 22' is pumped by the pump 70 back into the evaporator 20 via the junction device 54. In this configuration, the pump 70 pumps a secondary refrigerant fluid flow, e.g., a recirculation liquid refrigerant flow from the evaporator 20, via the liquid separator 22', back into the evaporator 20.

Figure 7C:
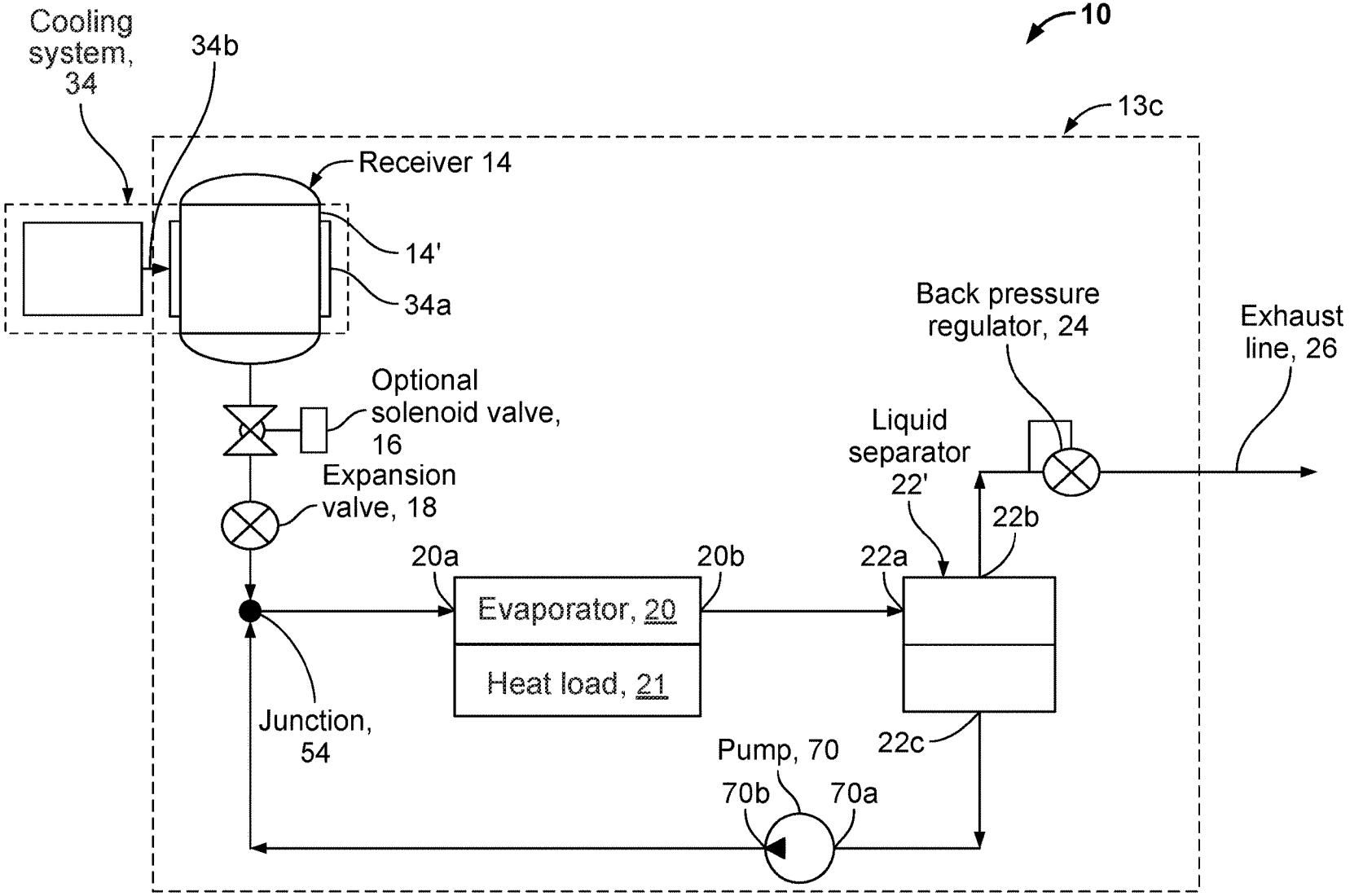

Referring now to FIG. 7C, another alternative OCRS 13*c* is shown. OCRS 13*c* includes the elements of OCRS 13*a*, as discussed above, except for cooling system 32. Instead, an alternative cooling system 34 is used. Cooling system 34 includes a cooling heat exchanger or evaporator 34*a* that is embedded within or about a shell portion 14' of the receiver 14. The cooling system 34 provides a temperature-controlled environment within the receiver 14. Cooling of the liquid refrigerant is provided by cooling fluid 34*b* that is flowed within the shell 14' of the refrigerant receiver 14, and which draws heat from the refrigerant in the receiver 14, as generally discussed in FIG. 3.

Figure 7D:
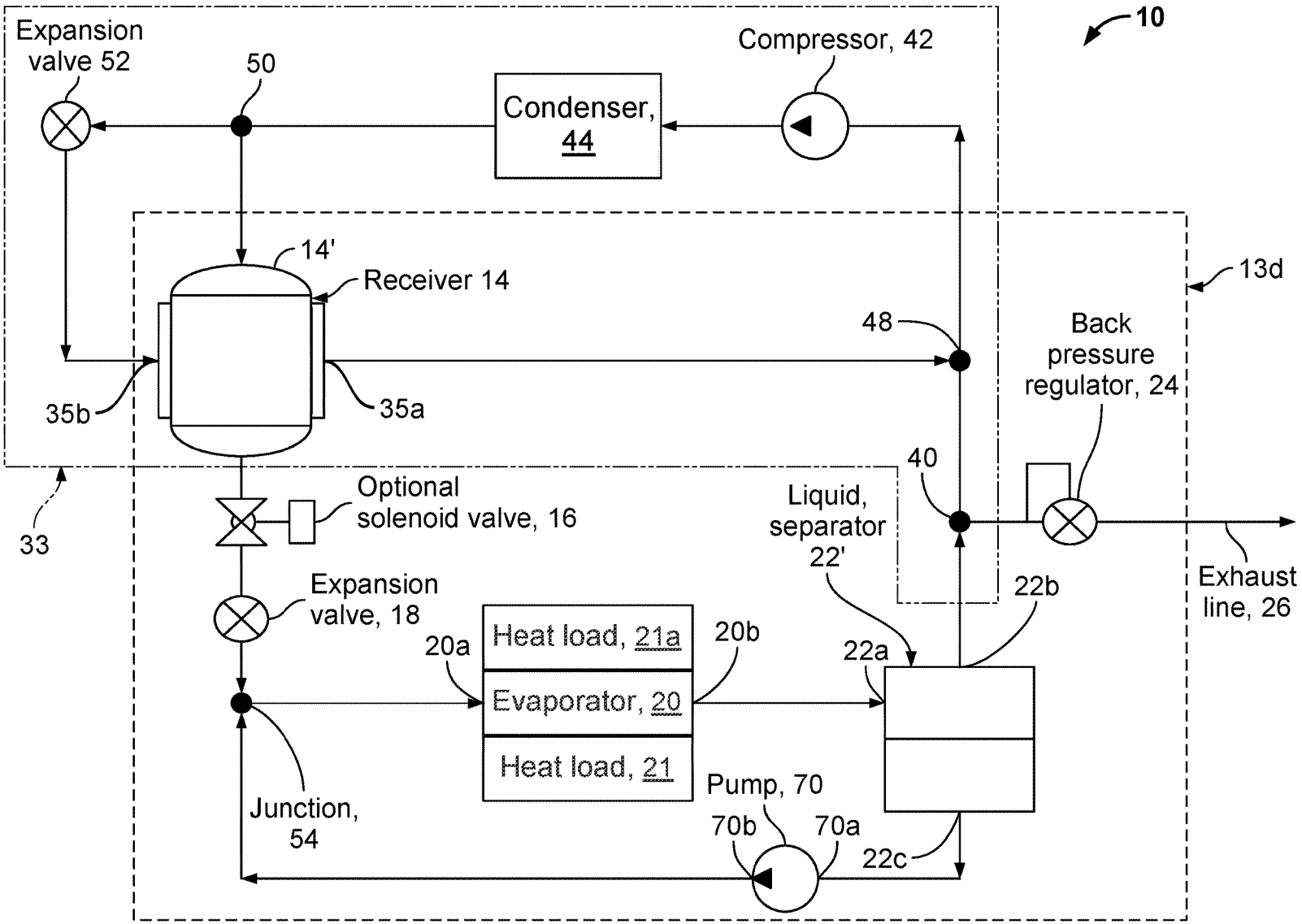

Referring now to FIG. 7D, another alternative OCRS 13*d* is shown. The system of FIG. 7D comprises a built-in cooling arrangement. The OCRS 13*d* includes the features of OCRS 11*a* except for the insulated container or compartment 28 and the external cooling system 30 of FIG. 1. Instead, the OCRS 13*d* includes an integrated closed-circuit cooling system 33 that comprises the receiver 14, a first junction 40 having an inlet coupled to the vapor side outlet 22*b* of the liquid separator 22', and having first and second junction outlets. One junction outlet is coupled to the inlet to the back-pressure regulator 24 and the other junction outlet is coupled to a first inlet of a second junction 48. A second inlet of the second junction 48 is coupled to an outlet 35*a* of a receiver shell (or jacket) 14', and an outlet of the junction 48 is coupled to an inlet of a compressor 42. A compressor outlet is coupled to an inlet of a condenser 44, with a condenser outlet coupled to an inlet of a third junction 50. A first outlet of the third junction 50 is coupled to an inlet of the receiver 14, whereas a second outlet of the third junction 50 is coupled to a second expansion valve 52. An outlet of the second expansion valve 52 is coupled to an inlet 35*b* of the receiver shell 14'. The outlet of the receiver 14 is coupled to the optional solenoid valve 16.

In this configuration, the addition of the compressor 42 and condenser 44 provides a closed loop path that is used to cool the refrigerant liquid in the receiver 14. The condenser 44 provides the coolant medium or cooling fluid that is flowed about the refrigerant receiver 14 and contacts the receiver shell 14' that functions as a cooling heat exchanger that draws heat from the refrigerant in the receiver 14, as generally discussed in FIG. 4.

In this configuration, the closed-circuit cooling system can be used to cool heat load 21 and heat load 21*a*, as generally discussed in FIG. 4.

The CCRS can include an evaporator arrangement (evaporator 20) with detailed examples shown in FIGS. 4B-4E. Other configuration can include two or three evaporators, as discussed in FIG. 7E below.

In addition, still other configurations include positioning of the junction device 54 prior to the inlet to the expansion valve 18 such that pumped liquid refrigerant passes through the expansion valve 18 together with liquid refrigerant that is received from the receiver 14. These configurations can also include two or three evaporators.

Various types of pumps can be used for pump 70. Exemplary pump types include gear, centrifugal, rotary vane, etc. When choosing a pump, the pump should be capable to withstand the expected fluid flows, including criteria such as temperature ranges for the fluids, and materials of the pump should be compatible with the properties of the fluid. A subcooled refrigerant can be provided at the pump 70 outlet to avoid cavitation. To do that a certain liquid level in the liquid separator 22' may provide hydrostatic pressure corresponding to that sub-cooling.

Figure 7E:
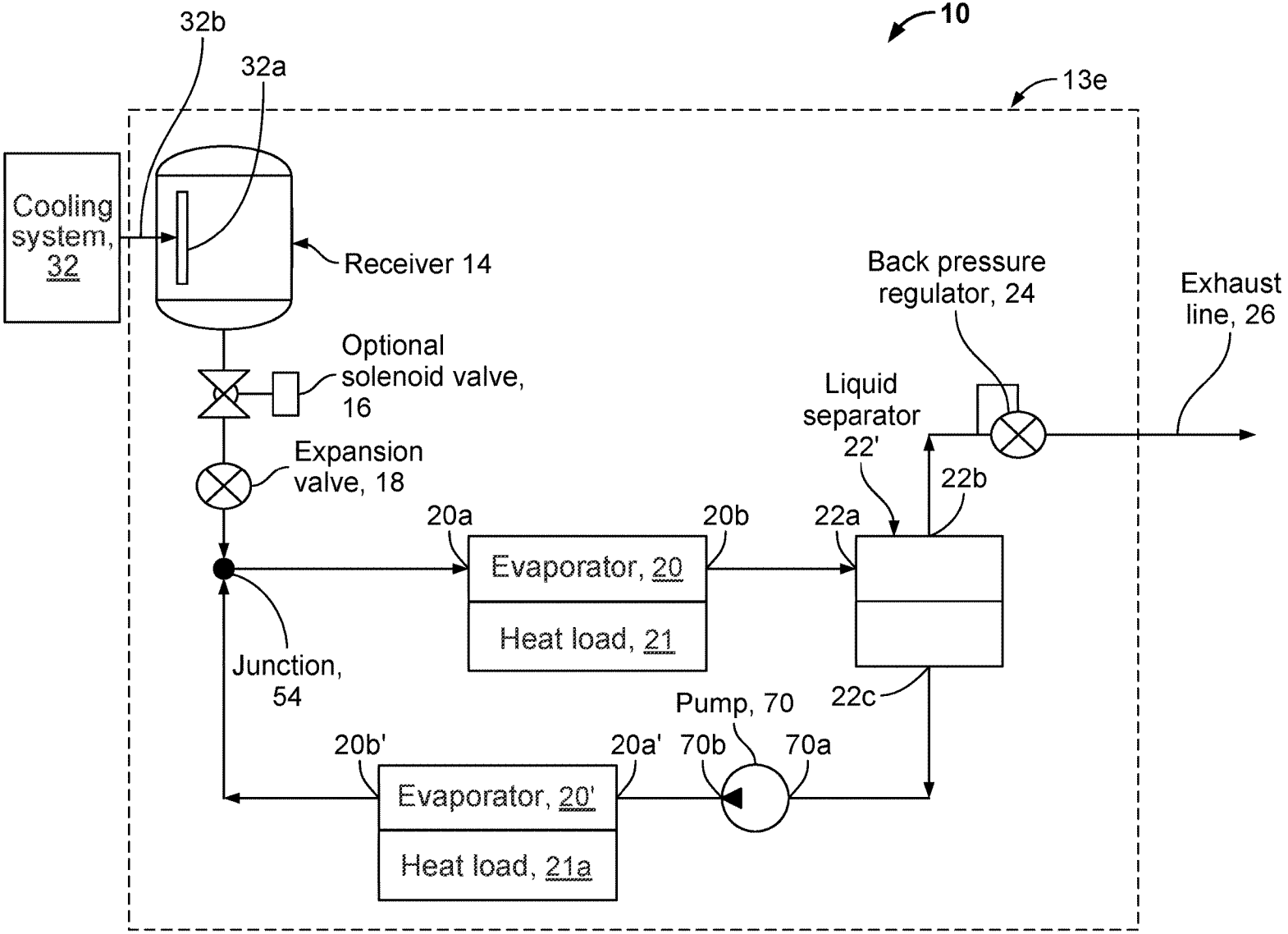

Referring to FIG. 7E, the TMS 10 includes an alternative OCRS 13*e*. OCRS 13*e* includes the elements of FIG. 7B, including cooling system 32, but also includes another evaporator 20'. This configuration includes two evaporators 20 and 20'. The configuration with two evaporators has the evaporator 20 coupled between an outlet of the junction 54 and the inlet 22*a* of the liquid separator 22', as shown, together with a second evaporator 20' having the inlet 20*a'* coupled to the outlet 70*b* of the pump 70 and having the outlet 20*b'* could to the junction device 54.

In addition, a second expansion valve (not shown) can have an inlet coupled to the liquid-side outlet 22*c* of the liquid separator 22' and have an outlet coupled to an inlet of a third evaporator (not shown) that operates under a superheat with or without superheat control. Thus, any of the alternative cooling systems 13*a*, 13*c* or 13*d* above can replace the cooling system 32 of FIG. 7E.

As shown in FIG. 5F above, the single evaporator 20" with the pair of refrigerant fluid paths 31*a*, 31*b* can also be used with any of the configurations of FIG. 7E.

Figure 7F:
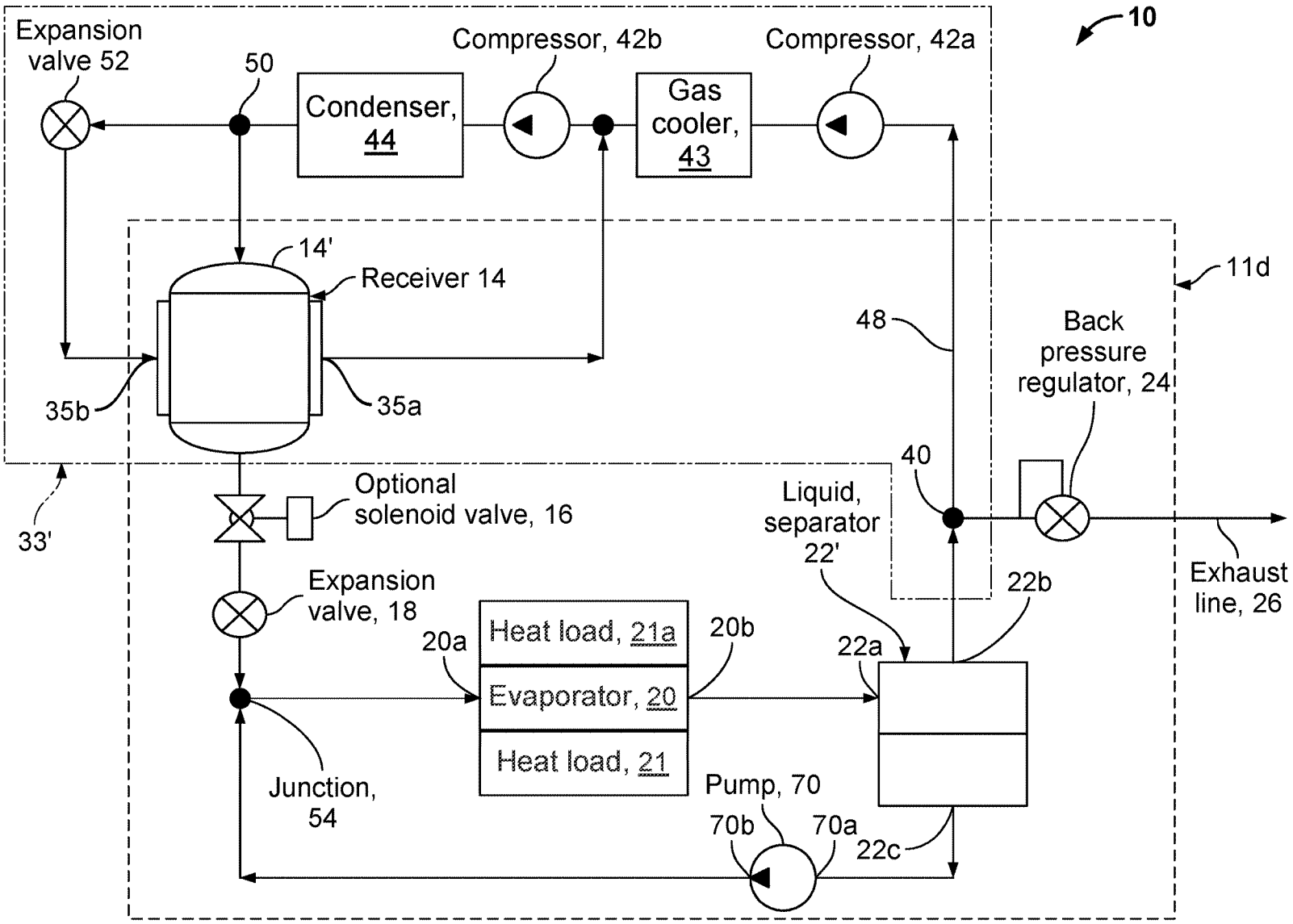

Referring now to FIG. 7F, this system is similar to that discussed in FIG. 7D but for the use of the pump 70, with the evaporator 20, and liquid separator 22'. Operation is similar to that discussed in FIG. 4D as modified by the pump 70 and thus also similar to that discussed in FIG. 7D.

Figure 8B:
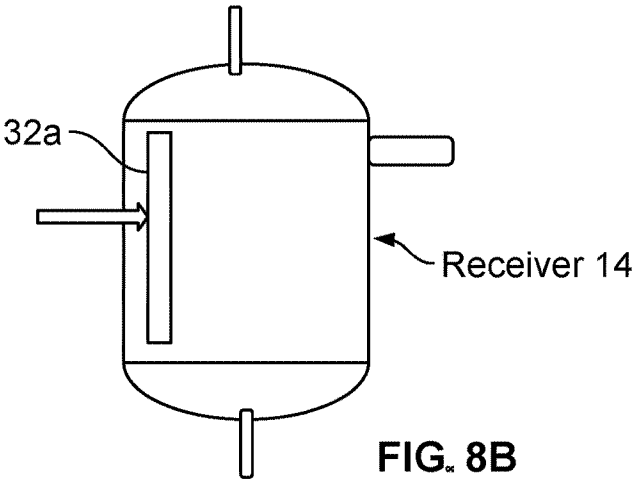
FIGS. 8A-8D are schematic diagrams showing alternative configurations of refrigerant receivers.
Figure 8D:
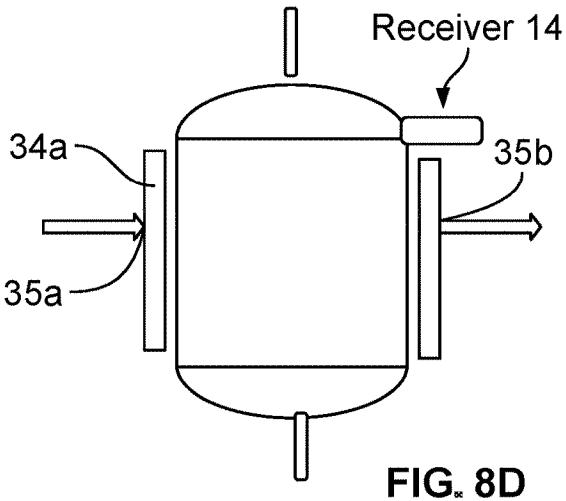
Figure 8A:
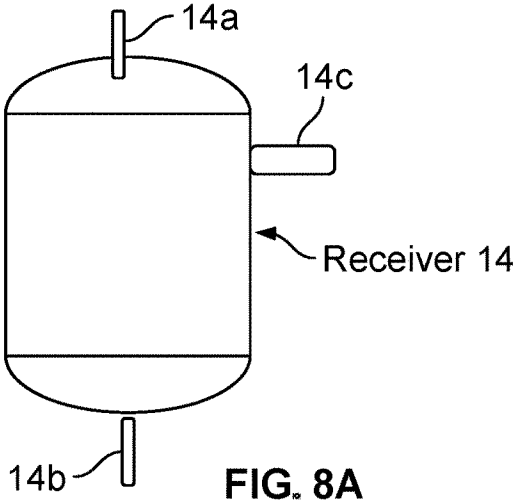

FIG. 8A shows an example of a receiver 14. Receiver 14 includes an inlet port 14*a*, an outlet port 14*b*. Receiver 14 may include a pressure relief valve 14*c*. Receiver 14 can have a variety of different shapes. In some embodiments, for example, the receiver is cylindrical. Examples of other possible shapes include, but are not limited to, rectangular prismatic, cubic, and conical.

FIG. 8B shows another example of the receiver. In FIG. 8B, the receiver 14 includes the cooling heat exchanger 32*a* or evaporator within the receiver 14.

Figure 8C:
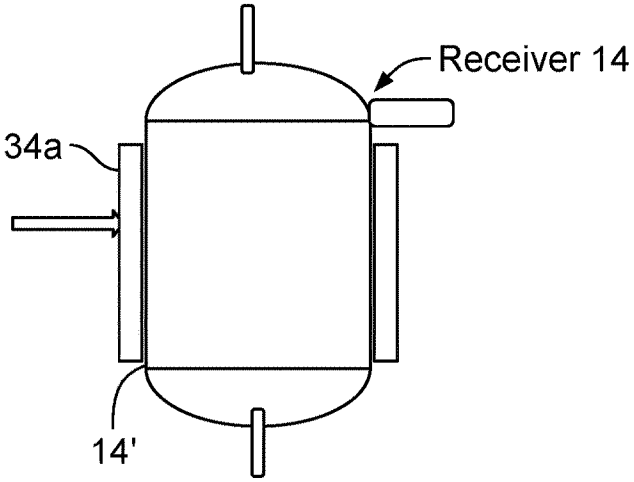

FIG. 8C shows another example of the receiver. In FIG. 8C, the receiver 14 includes the cooling heat exchanger or evaporator 34*a* embedded within the shell 14' of the receiver 14.

FIG. 8D shows another example of the receiver. In FIG. 8D, the receiver 14 includes the cooling heat exchanger or evaporator 34*a* embedded within the shell 14' of the receiver 14 as part of the closed-circuit path (not shown). The cooling heat exchanger 34*a* has an inlet 35*a* and an outlet 35*b*, as shown.

Figure 8E:
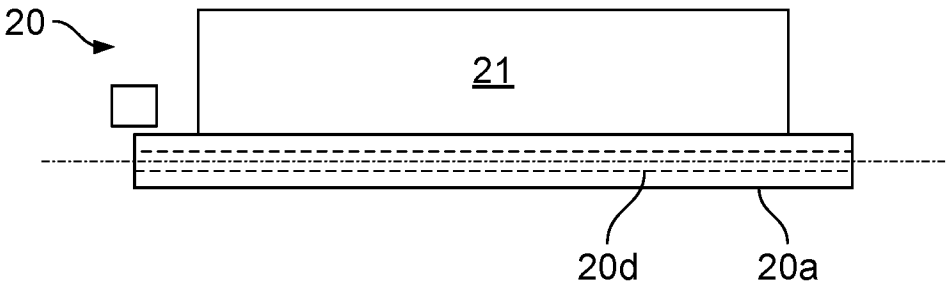
FIGS. 8E-8F are schematic diagrams showing side and end views, respectively, of an example of a thermal load and an evaporator that includes refrigerant fluid channels.
Figure 8G:
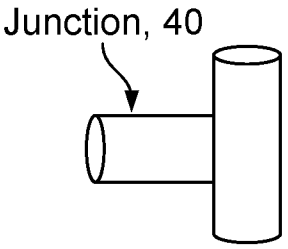
FIG. 8G is a schematic diagram showing a junction.
Figure 8F:
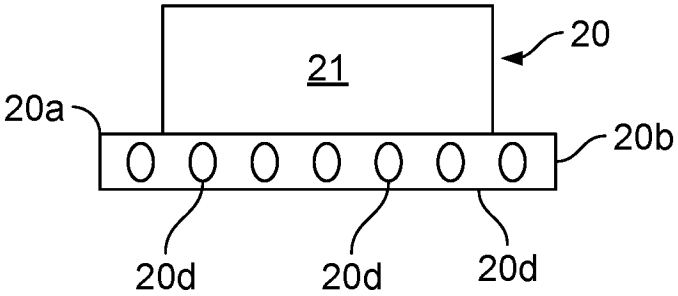

Referring to FIGS. 8E and 8F an exemplary evaporator 20 is shown. The evaporator 20 has a heat load 21 in thermal contact with one or more integrated refrigerant fluid channels 20*d*. The portion of heat load 21 in thermal contact with the refrigerant fluid channels 20*d* effectively functions as the evaporator 20 for the system 10. In some embodiments, evaporator 20 (or certain components thereof) can be fabricated as part of heat load 21 or otherwise integrated into heat load 21.

Evaporator 20 can be implemented in a variety of ways. In general, evaporator 20 functions as a heat exchanger, providing thermal contact between the refrigerant fluid and heat load 21. Typically, evaporator 20 includes one or more flow channels extending internally between the inlet 20*a* and the outlet 20*b* of the evaporator 20, allowing refrigerant fluid to flow through the evaporator 20 and absorb heat from heat load 21.

A variety of different evaporators can be used in system 10. In general, any cold plate may function as the evaporator of the open-circuit refrigeration systems 12 disclosed herein. Evaporator 20 can accommodate any refrigerant fluid channels (including mini/micro-channel tubes), blocks of printed circuit heat exchanging structures, or more generally, any heat exchanging structures that are used to transport single-phase or two-phase fluids. The evaporator and/or components thereof, such as fluid transport channels, can be attached to the heat load mechanically, or can be welded, brazed, or bonded to the heat load in any manner.

In the examples included herein, the operating pressure in the evaporator 20 tends to be in equilibrium with the surrounding temperature and is different for different refrigerants. The pressure in the evaporator also depends on the evaporating temperature, which is lower than the heat load temperature and is defined during design of the system. The system is operational as long as there is sufficient liquid refrigerant in the liquid separator 22' to drive adequate refrigerant fluid flow through the evaporator 20.

FIG. 8G illustrates a junction device, such as junction devices 40, 48, 50, and 54.

III. System Operational Control

An important system operating parameter is the vapor quality of the refrigerant fluid emerging from evaporator 20. The vapor quality, which is a number from 0 to 1, represents the fraction of the refrigerant fluid that is in the vapor phase. As mentioned above, for a particular volume of refrigerant fluid propagating through evaporator 20, relatively high amounts of the refrigerant fluid can remain in liquid form right up to the point at which the exit aperture of evaporator 20 is reached. Also, if the fluid is fully converted to the vapor phase after propagating only partially through evaporator 20, further heat absorption by the (now vapor-phase) refrigerant fluid within evaporator 20 will lead to a temperature increase of the refrigerant fluid and heat load 21.

The evaporator 20 is configured to maintain exit vapor quality substantially below the critical vapor quality defined as "1." Vapor quality is the ratio of mass of vapor to mass of liquid+vapor and is generally kept in a range of approximately 0.3 to almost 1.0; more specifically 0.3 to 0.8 and any value within said range. "Vapor quality" thus when defined as mass of vapor/total mass (vapor+liquid), in this sense, the vapor quality cannot exceed "1" or be equal to a value less than "0."

In practice, vapor quality may be expressed as "equilibrium thermodynamic quality" that is calculated as follows:

$$X=(h-h')/(h''-h'),$$

where h—is specific enthalpy, specific entropy or specific volume, '—means saturated liquid and "—means saturated vapor. In this case X can be mathematically below 0 or above 1, unless the calculation process is forced to operate differently. Either approach is acceptable.

Another important operating consideration for TMS 10 is the mass flow rate of refrigerant fluid within the system. Evaporator 20 can be configured to provide a higher mass flow rate controlling lower vapor quality than the arrangement in the above application. In general, a more limited number of measurement and control strategies can be implemented in TMS 10 to achieve the control objectives discussed above.

The back-pressure regulator 24 can also be optionally implemented as a mechanical back-pressure regulator (or electrically control-able). In general, mechanical back-pressure regulators that are suitable for use in the systems disclosed herein include an inlet, an outlet, and an adjustable internal orifice. To regulate the internal orifice, the mechanical back-pressure regulator senses the in-line pressure of refrigerant fluid entering through the inlet, and adjusts the size of the orifice accordingly to control the flow of refrigerant fluid through the regulator and thus, to regulate the upstream refrigerant fluid pressure in the system.

In some embodiments, the systems disclosed herein can include measurement devices featuring one or more system sensors and/or measurement devices that measure various system properties and operating parameters, and transmit electrical signals corresponding to the measured information. To measure the evaporating pressure ($p_e$), a sensor (not shown) is optionally positioned between the inlet 20*a* and outlet 20*b* of evaporator 20, i.e., internal to evaporator 20.

TMS 10 includes an optional temperature sensor (not shown) positioned adjacent to an inlet 20*a* or an outlet 20*b* of evaporator 20 or between the inlet and the outlet.

The foregoing temperature sensors can be implemented in a variety of ways in system 10, e.g., as thermocouples and thermistors. TMS 10 can include a vapor quality sensor that measures vapor quality of the refrigerant fluid emerging from evaporator 20. Examples of commercially available vapor quality sensors include, but are not limited to, HBX sensors (available from HB Products, Hasselager, Denmark).

It should be appreciated that in the foregoing discussion, any one or various combinations of two sensors can be used.

Certain set point values represent a maximum allowable value of a system parameter, and if the measured value is equal to the set point value (or differs from the set point value by 10% or less (e.g., 5% or less, 3% or less, 1% or less) of the set point value), a controller 17 (not shown) adjusts the back-pressure regulator 24 to adjust the operating state of the TMS10 and reduce the system parameter value.

Certain set point values represent a minimum allowable value of a system parameter, and if the measured value is equal to the set point value (or differs from the set point value by 10% or less (e.g., 5% or less, 3% or less, 1% or less) of the set point value), the controller 17 adjusts back-pressure regulator 24 to adjust the operating state of the system, and increase the system parameter value.

Some set point values represent "target" values of system parameters. For such system parameters, if the measured parameter value differs from the set point value by 1% or more (e.g., 3% or more, 5% or more, 10% or more, 20% or more), the controller 17 adjusts back-pressure regulator 24 to adjust the operating state of the system, so that the system parameter value more closely matches the set point value.

In the foregoing examples, measured parameter values are assessed in relative terms based on set point values (i.e., as a percentage of set point values). Alternatively, in some embodiments, measured parameter values can be assessed in absolute terms. For example, if a measured system parameter value differs from a set point value by more than a certain amount (e.g., by 1 degree C. or more, 2 degrees C. or more, 3 degrees C. or more, 4 degrees C. or more, 5 degrees C. or more), the controller 17 adjusts back-pressure regulator 24 to adjust the operating state of the system, so that the measured system parameter value more closely matches the set point value.

Figure 9C:
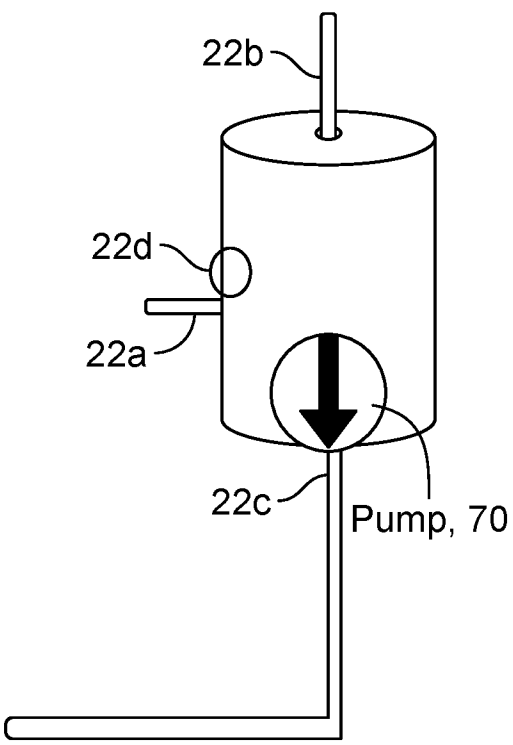
FIGS. 9A-9C are schematic diagrams of configurations for coupling of a liquid separator in the TMS.
Figure 9B:
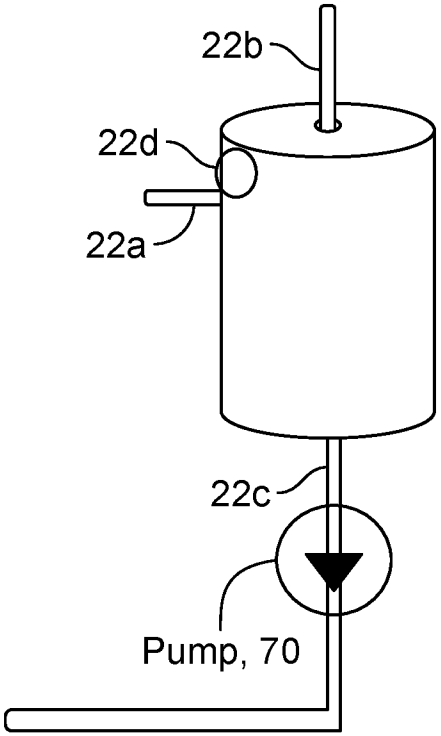
Figure 9A:
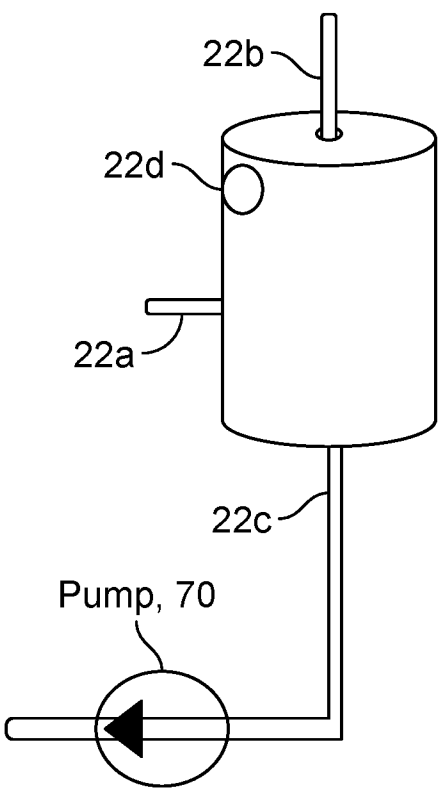

FIGS. 9A-9C depict alternative configurations of the liquid separator 22' (implemented as a flash drum, for example), which has ports 22*a*-22*c* coupled to conduits (not referenced) and a sensor 22*d*, especially useful for the open-circuit refrigeration system configurations.

In FIG. 9A, the pump 70 is located distal from the liquid-side outlet 22*c*. This configuration potentially presents the possibility of cavitation. To minimize the possibility of cavitation one of the configurations of FIG. 9B or 9C can be used.

In FIG. 9B, the pump 70 is located distal from the liquid-side outlet 22*c*, but the height at which the pump inlet is located is higher than that of FIG. 9A. This would result in an increase in liquid pressure at the liquid-side outlet 22*c* of the liquid separator 22' and concomitant therewith an increase in liquid pressure at the inlet of the pump 70. Increasing the pressure at the inlet to the pump 70 should minimize possibility of cavitation.

Another strategy is presented in FIG. 9C, where the pump 70 is located proximate to or indeed, as shown, inside of the liquid-side outlet 22*c*. In addition, although not shown, the height at which the inlet 22*a* is located can be adjusted to that of FIG. 9B, rather than the height of FIG. 9A as shown in FIG. 9C. This would result in an increase in liquid pressure at the inlet of the pump 70 further minimizing the possibility of cavitation.

Another alternative strategy that can be used for any of the configurations depicted involves the use of a sensor (not shown) that produces a signal that is a measure of the height of a column of liquid in the liquid separator 22'. The signal is sent to the controller 17 (not shown) that will be used to start the pump 70, once a sufficient height of liquid is contained by the liquid separator 22'.

IV. Additional Features of Thermal Management Systems

The foregoing examples of TMS illustrate a number of features that are included in any of the systems within the scope of this description. In addition, a variety of other features is present in such systems.

In certain embodiments, refrigerant fluid that is discharged from evaporator 20 and passes through conduit and back-pressure regulator 24 is directly discharged as exhaust from conduit without further treatment. Direct discharge provides a convenient and straightforward method for handling spent refrigerant, and has the added advantage that over time, the overall weight of the system is reduced due to the loss of refrigerant fluid. For systems that are mounted to small vehicles or are otherwise mobile, this reduction in weight is important.

In some embodiments, however, refrigerant fluid vapor is further processed before it is discharged. Further processing may be desirable depending upon the nature of the refrigerant fluid that is used, as direct discharge of unprocessed refrigerant fluid vapor may be hazardous to humans and/or may be deleterious to mechanical and/or electronic devices in the vicinity of the system. For example, the unprocessed refrigerant fluid vapor may be flammable or toxic, or may corrode metallic device components. In situations such as these, additional processing of the refrigerant fluid vapor may be desirable.

In general, refrigerant processing apparatus can be implemented in various ways. In some embodiments, refrigerant processing apparatus is a chemical scrubber or water-based scrubber. Within apparatus, the refrigerant fluid is exposed to one or more chemical agents that treat the refrigerant fluid vapor to reduce its deleterious properties. For example, where the refrigerant fluid vapor is basic (e.g., ammonia) or acidic, the refrigerant fluid vapor can be exposed to one or more chemical agents that neutralize the vapor and yield a less basic or acidic product that can be collected for disposal or discharged from apparatus.

Another example has the refrigerant vapor exposed to one or more chemical agents that oxidize, reduce, or otherwise react with the refrigerant fluid vapor to yield a less reactive product that is collected for disposal or discharged from apparatus. Other examples are possible.

In certain embodiments, refrigerant vapor processing apparatus is implemented as an adsorptive sink for the refrigerant fluid. Apparatus can include, for example, an adsorbent material bed that binds particles of the refrigerant fluid vapor, trapping the refrigerant fluid within apparatus and preventing discharge. The adsorptive process can sequester the refrigerant fluid particles within the adsorbent material bed, which can then be removed from apparatus and sent for disposal.

In some embodiments, where the refrigerant fluid is flammable, refrigerant vapor processing apparatus is implemented as an incinerator. Incoming refrigerant fluid vapor is mixed with oxygen or another oxidizing agent and ignited to combust the refrigerant fluid. The combustion products are discharged from the incinerator or collected (e.g., via an adsorbent material bed) for later disposal.

As an alternative, refrigerant vapor processing apparatus can also be implemented as a combustor of an engine or another mechanical power-generating device. Refrigerant fluid vapor is mixed with oxygen, for example, and combusted in a piston-based engine or turbine to perform mechanical work, such as providing drive power for a vehicle or driving a generator to produce electricity. In certain embodiments, the generated electricity is used to provide electrical operating power for one or more devices, including a thermal load.

V. Integration with Power Systems

In some embodiments, the refrigeration systems disclosed herein can be combined with power systems to form integrated power and thermal systems, in which certain components of the integrated systems are responsible for providing refrigeration functions and certain components of the integrated systems are responsible for generating operating power.

Figure 10:
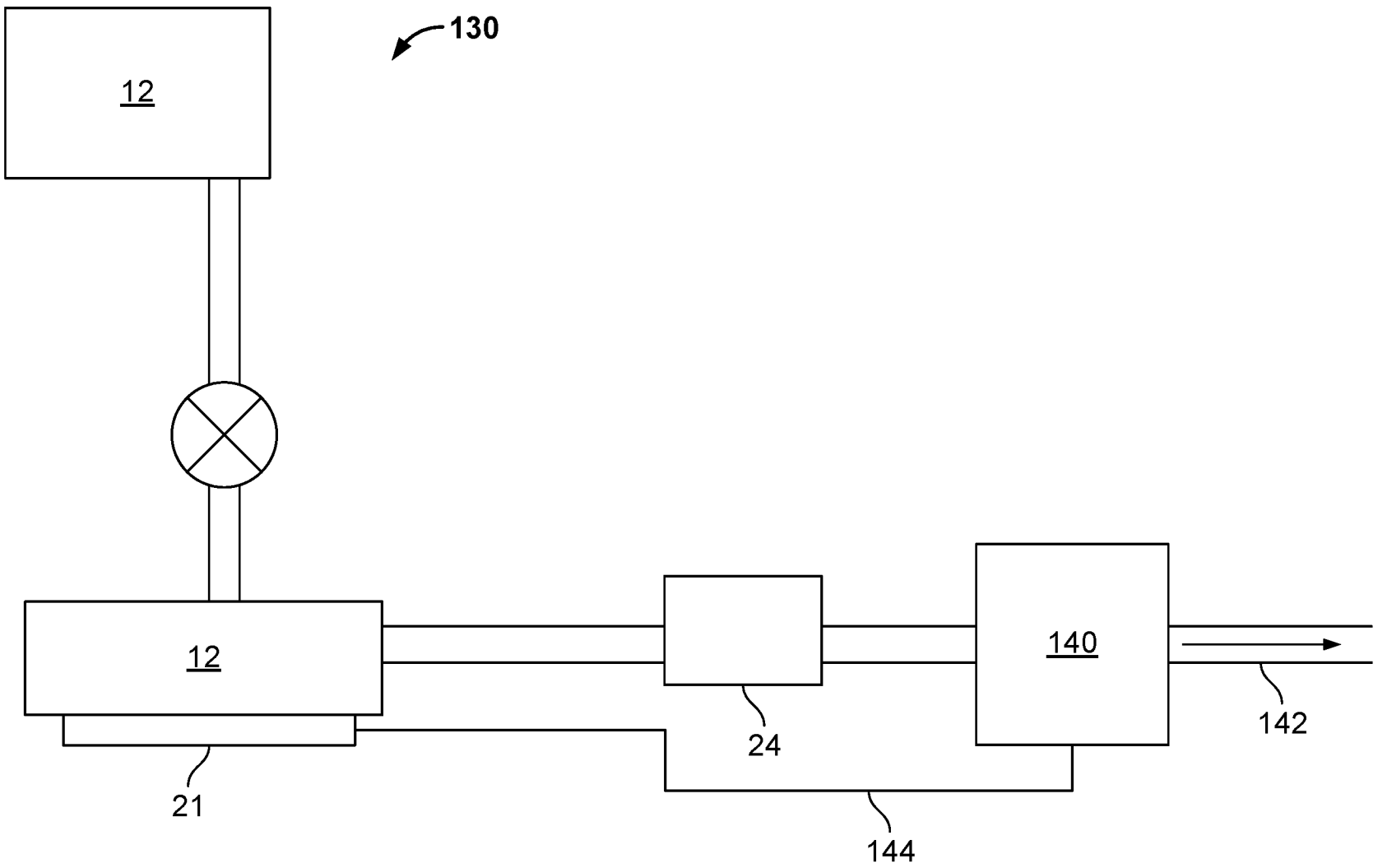
FIG. 10 is a schematic diagram of an example of a TMS that includes a power generation apparatus.

FIG. 10 shows an integrated power and TMS 130 that includes many features similar to those discussed above. The TMS 130 includes the OCRS 11, 12, or 13 and back-pressure regulator 24. In addition, system 130 includes an engine 140 with an inlet that receives the stream of waste refrigerant fluid that enters conduit after passing through back-pressure regulator 24. Engine 140 can combust the waste refrigerant fluid directly, or alternatively, can mix the waste refrigerant fluid with one or more additives (such as oxidizers) before combustion. Where ammonia is used as the refrigerant fluid in system 130, suitable engine configurations for both direct ammonia combustion as fuel, and combustion of ammonia mixed with other additives, can be implemented. In general, combustion of ammonia improves the efficiency of power generation by the engine.

The energy released from combustion of the refrigerant fluid can be used by engine 140 to generate electrical power, e.g., by using the energy to drive a generator. The electrical power is delivered via electrical connection 144 to thermal load 21 to provide operating power for the load. For example, in certain embodiments, thermal load 21 includes one or more electrical circuits and/or electronic devices, and engine 140 provides operating power to the circuits/devices via combustion of refrigerant fluid. Byproducts of the combustion process is discharged from engine 140 via exhaust conduit 142, as shown in FIG. 10.

Various types of engines and power-generating devices are implemented as engine 140 in system 130. In some embodiments, for example, engine 140 is a conventional four-cycle piston-based engine, and the waste refrigerant fluid is introduced into a combustor of the engine. In certain embodiments, engine 140 is a gas turbine engine, and the waste refrigerant fluid is introduced via the engine inlet to the afterburner of the gas turbine engine.

VII. Integration with Directed Energy Systems

The TMS and methods disclosed herein can be implemented as part of (or in conjunction with) directed energy systems such as high energy laser systems. Due to their nature, directed energy systems typically present a number of cooling challenges, including certain heat loads for which temperatures are maintained during operation within a relatively narrow range.

Figure 11:
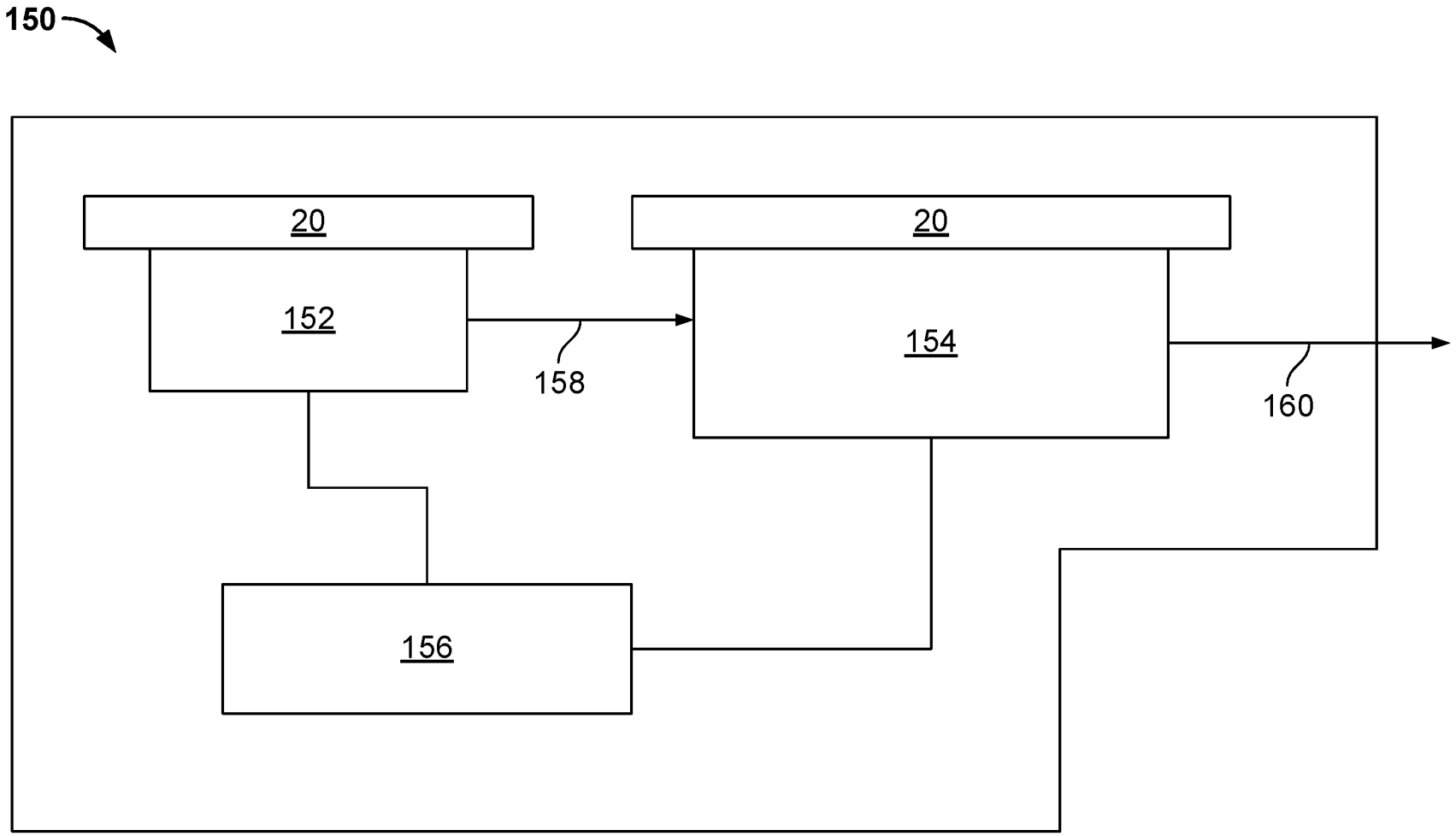
FIG. 11 is a schematic diagram of an example of directed energy system that includes a TMS.

FIG. 11 shows one example of a directed energy system, specifically, a high energy laser system 150. System 150 includes a bank of one or more laser diodes 152 and an amplifier 154 connected to a power source 156. During operation, laser diodes 152 generate an output radiation beam 158 that is amplified by amplifier 154, and directed as output beam 160 onto a target. Generation of high energy output beams can result in the production of significant quantities of heat. Certain laser diodes, however, are relatively temperature sensitive, and the operating temperature of such diodes is regulated within a relatively narrow range of temperatures to ensure efficient operation and avoid thermal damage. Amplifiers are also temperature-sensitive, although typically less sensitive than diodes.

To regulate the temperatures of various components of directed energy systems such as diodes 152 and amplifier 154, such systems can include components and features of the TMS disclosed herein. In FIG. 11, evaporator 20 is coupled to diodes 152 and amplifier 154, although it should be understood that embodiments with multiple evaporators could provide a separate evaporator to cool diodes 152 separately from amplifier 154. The other components of the TMS disclosed herein are not shown for clarity. However, it should be understood that any of the features and components discussed above can optionally be included in directed energy systems. Diodes 152, due to their temperature-sensitive nature, effectively function as heat load 21 in system 150, while amplifier 154 may function as either a separate heat load or as part of heat load 21.

System 150 is one example of a directed energy system that can include various features and components of the TMS and methods described herein. However, it should be appreciated that the TMS and methods are general in nature, and is applied to cool a variety of different heat loads under a wide range of operating conditions.

VIII. Hardware and Software Implementations

Figure 12:
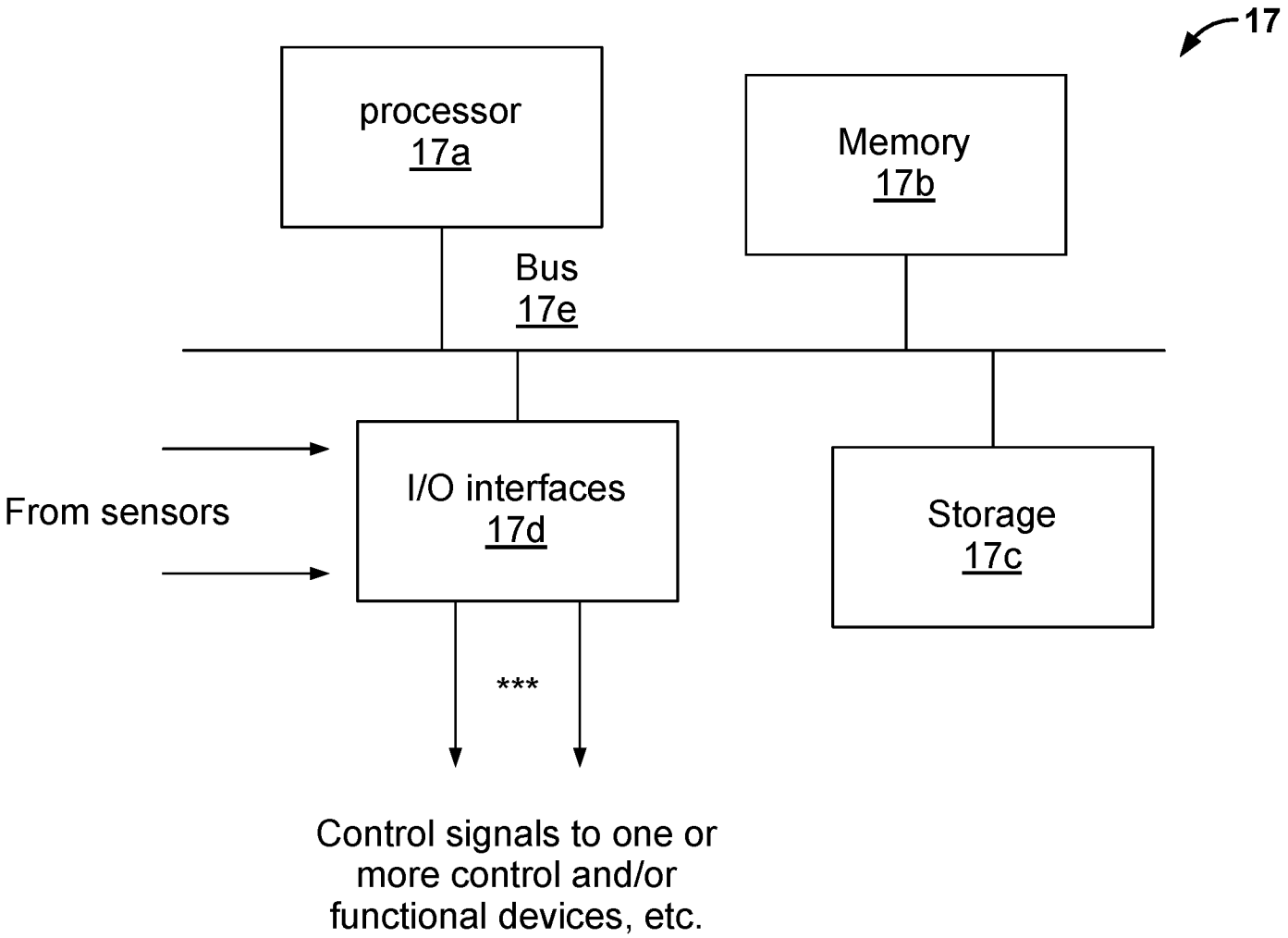
FIG. 12 is a schematic diagram of a controller.

Referring now to FIG. 12, a controller 17 can generally be implemented as any one of a variety of different electrical or electronic computing or processing devices, and can perform any combination of the various steps discussed above to control various components of the disclosed TMS.

Controller 17 can generally, and optionally, include any one or more of a processor 17*a* (or multiple processors), a memory 17*b*, a storage device 17*c*, and input/output devices or interfaces 17*d*. Some or all of these components are interconnected using a system bus 17*e*. The processor 17*a* is capable of processing instructions for execution. In some embodiments, the processor 17*a* is a single-threaded processor. In certain embodiments, the processor 17*a* is a multi-threaded processor. Typically, the processor 17*a* is capable of processing instructions stored in the memory 17*b* or on the storage device 17*c* to display graphical information for a user interface on an input/output device 17*d*, and to execute the various monitoring and control functions discussed above. Suitable processors for the systems disclosed herein include both general and special purpose microprocessors, and the sole processor or one of multiple processors of any kind of computer or computing device.

The memory 17*b* stores information within the system, and is a computer-readable medium, such as a volatile or non-volatile memory. The storage device 17*c* is capable of providing mass storage for the controller 17. In general, the storage device 17*c* can include any non-transitory tangible media configured to store computer readable instructions. For example, the storage device 17*c* can include a computer-readable medium and associated components, including: magnetic disks, such as internal hard disks and removable disks; magneto-optical disks; and optical disks. Storage devices suitable for tangibly embodying computer program instructions and data include all forms of non-volatile memory including, by way of example, semiconductor memory devices, such as EPROM, EEPROM, and flash memory devices; magnetic disks such as internal hard disks and removable disks; magneto-optical disks; and CD-ROM and DVD-ROM disks. Processors and memory units of the systems disclosed herein is supplemented by, or incorporated in, ASICs (application-specific integrated circuits).

The input/output devices 17*d* provide input/output operations for controller 17, and can include a keyboard and/or pointing device. In some embodiments, the input/output devices 17*d* include a display unit for displaying graphical user interfaces and system related information.

The features described herein, including components for performing various measurement, monitoring, control, and communication functions, is implemented in digital electronic circuitry, or in computer hardware, firmware, or in combinations of them. Methods steps is implemented in a computer program product tangibly embodied in an information carrier, e.g., in a machine-readable storage device, for execution by a programmable processor (e.g., of controller 17), and features are performed by a programmable processor executing such a program of instructions to perform any of the steps and functions described above. Computer programs suitable for execution by one or more system processors include a set of instructions that are used, directly or indirectly, to cause a processor or other computing device executing the instructions to perform certain activities, including the various steps discussed above.

Computer programs suitable for use with the systems and methods disclosed herein is written in any form of programming language, including compiled or interpreted languages, and is deployed in any form, including as standalone programs or as modules, components, subroutines, or other units suitable for use in a computing environment.

In addition to one or more processors and/or computing components implemented as part of controller 17, the systems disclosed herein can include additional processors and/or computing components within any of the control device (e.g., expansion valve 18 and/or 52 and/or back-pressure regulator 24) and any of the sensors discussed above. Processors and/or computing components of the control device and sensors, and software programs and instructions that are executed by such processors and/or computing components, can generally have any of the features discussed above in connection with controller 17.

OTHER EMBODIMENTS

A number of embodiments have been described. Nevertheless, it will be understood that various modifications may be made without departing from the spirit and scope of the disclosure. Accordingly, other embodiments are within the scope of the following claims.

What is claimed is:

1. A thermal management system, comprising:

a cooling system configured to supply a cooling medium;

a receiver having a receiver outlet, the receiver configurable to store a refrigerant fluid, with the cooling system configurable to cool the refrigerant fluid in the receiver with the cooling medium;

an evaporator in thermal conductive contact with a heat load and coupled to the receiver outlet, the evaporator configurable to receive refrigerant fluid from the receiver outlet and to extract heat from the heat load;

a control device configurable to control a temperature of the heat load; and an exhaust line, with the receiver, the evaporator, the control device, and the exhaust line coupled to form an open-circuit refrigerant fluid flow path.

2. The system of claim 1, further comprising:

a suction accumulator having an inlet coupled to an evaporator outlet of the evaporator and a vapor side outlet coupled to a control device inlet of the control device, the suction accumulator configurable to separate the refrigerant fluid from the evaporator into refrigerant vapor and refrigerant liquid and provide the refrigerant vapor at the vapor side outlet of the suction accumulator.

3. The system of claim 1 wherein the refrigerant fluid comprises ammonia.

4. The system of claim 2 wherein the cooling system comprises:

a thermally insulated container that houses the receiver, the evaporator and the suction accumulator.

5. The system of claim 4 wherein the control device is included in the thermally insulated container.

6. The system of claim 4 wherein the control device is not included in the thermally insulated container.

7. The system of claim 4 wherein the cooling system further comprises:

a source of coolant medium, with the source being proximate to the thermally insulated container.

8. The system of claim 1 wherein the cooling system comprises:

an evaporator cooler or a heat exchanger within the receiver, and the cooling system is proximate to the evaporator cooler or heat exchanger.

9. The system of claim 1 wherein the receiver comprises:

a receiver shell; and an evaporator cooler or a heat exchanger integrated within the receiver shell.

10. The system of claim 1 wherein the exhaust line is configured to emit the refrigerant fluid without returning the emitted refrigerant fluid to the receiver.

11. The system of claim 1 wherein the control device is a back-pressure regulator.

12. The system of claim 1 further comprising a controller configured to control operation of the control device.

13. The system of claim 1 wherein the system is configured to operate the evaporator at a defined vapor quality in a range of 0.3 to almost 1.0.

14. A thermal management method comprises:

cooling, by a cooling system, a refrigerant fluid within a receiver of an open-circuit refrigeration system;

transporting the refrigerant fluid through the open-circuit refrigeration system from a receiver outlet of the receiver to an evaporator in contact with a heat load and having an evaporator inlet and an evaporator outlet, while extracting heat from a heat load in thermal conductive contact with the evaporator; and controlling a temperature of the heat load based on exhausting the refrigerant fluid though a control device coupled to the evaporator outlet of the evaporator, the receiver, the control device, and an exhaust line coupled to form an open-circuit refrigerant fluid flow path.

15. The method of claim 14, further comprising:

separating, with a liquid separator, refrigerant fluid from the evaporator outlet into a liquid phase and a vapor phase; and transporting the vapor phase from a vapor-side outlet of the liquid separator to an inlet of the control device.

16. The method of claim 14 wherein the refrigerant fluid comprises ammonia.

17. The method of claim 14 wherein cooling further comprises:

housing the open-circuit refrigeration system in a thermally insulated container; and directing cooling medium into the thermally insulated container.

18. The method of claim 17 wherein the control device is included in the thermally insulated container and the exhaust line is not included in the thermally insulated container.

19. The method of claim 17 wherein the control device is not included in the thermally insulated container.

20. The method of claim 17 wherein cooling further comprises:

directing cooling medium from the cooling system that is proximate to the thermal insulated container.

21. The method of claim 14 wherein cooling further comprises:

cooling the receiver by an evaporator cooler or a heat exchanger disposed in the receiver, with a cooling system that is proximate to the evaporator cooler or heat exchanger.

22. The method of claim 14 wherein cooling further comprises:

cooling the receiver with an evaporator cooler or a heat exchanger integrated within a receiver shell with a cooling system that is proximate to the evaporator cooler or heat exchanger.

23. The method of claim 14 wherein when the control device is actuated, the exhaust line discharges refrigerant vapor without returning the discharged refrigerant vapor to the receiver.

24. The method of claim 14 wherein the control device is a back pressure regulator.

25. The method of claim 24 wherein a controller is configured to control operation of the back pressure regulator, by receiving a signal from a sensor device that is configured to measure a thermodynamic property of the refrigerant fluid in the open-circuit refrigerant fluid flow path.

26. The method of claim 14 wherein the system is configured to operate the evaporator at a defined vapor quality in a range of 0.3 to almost 1.0.

27. The method of claim 14, wherein the heat load comprises one or more of a diode, an amplifier, a directed energy system, or a high energy laser system configured to generate high energy output radiation beams.

28. The system of claim 1, wherein the heat load comprises one or more of a diode, an amplifier, a directed energy system, or a high energy laser system configured to generate high energy output radiation beams.

* * * * *